US011261516B2

(12) United States Patent
Detweiler et al.

(10) Patent No.: US 11,261,516 B2
(45) Date of Patent: Mar. 1, 2022

(54) METHODS AND SYSTEMS FOR COATING A STEEL SUBSTRATE

(71) Applicant: PUBLIC JOINT STOCK COMPANY "SEVERSTAL", Cherepovets (RU)

(72) Inventors: Zachary M. Detweiler, Sunnyvale, CA (US); Joseph E. McDermott, Sunnyvale, CA (US); Adam G. Thomas, Sunnyvale, CA (US); Daniel E. Bullard, Sunnyvale, CA (US); Martin Janousek, Sunnyvale, CA (US)

(73) Assignee: PUBLIC JOINT STOCK COMPANY "SEVERSTAL", Cherepovets (RU)

( * ) Notice: Subject to any disclaimer, the term of this patent is extended or adjusted under 35 U.S.C. 154(b) by 357 days.

(21) Appl. No.: 16/193,616

(22) Filed: Nov. 16, 2018

(65) Prior Publication Data

US 2019/0153581 A1 May 23, 2019

Related U.S. Application Data

(63) Continuation of application No. PCT/US2017/033559, filed on May 19, 2017.

(Continued)

(51) Int. Cl.

*C23C 10/26* (2006.01)
*C23C 10/20* (2006.01)

(Continued)

(52) U.S. Cl.

CPC ..... *C23C 10/26* (2013.01); *C21D 1/26* (2013.01); *C21D 9/46* (2013.01); *C22C 38/001* (2013.01);

(Continued)

(58) Field of Classification Search

None

See application file for complete search history.

(56) References Cited

U.S. PATENT DOCUMENTS 2,044,742 A 6/1936 Armstrong et al.
2,402,834 A 6/1946 Nachtman (Continued)

FOREIGN PATENT DOCUMENTS

CA 1170838 A 7/1984
CN 1060116 A 4/1992

(Continued)

OTHER PUBLICATIONS

Kato (Thin solid film, 1998, vol. 319, p. 132-139). (Year: 1998).*

(Continued)

*Primary Examiner* — Xiaowei Su

(74) *Attorney, Agent, or Firm* — Notaro, Michalos & Zaccaria P.C.

(57) ABSTRACT

The present disclosure provides systems and methods for depositing a metal layer adjacent to or on a substrate. Substrates may comprise, for example, one or more of iron, chromium, nickel, silicon, vanadium, titanium, boron, tungsten, aluminum, molybdenum, cobalt, manganese, zirconium, and niobium, oxides thereof, nitrides thereof, sulfides thereof, or any combination thereof. A substrate may be a steel substrate. A metal layer may be deposited via, for example, roll coating, vapor deposition, slurry deposition, or electrochemical deposition.

24 Claims, 4 Drawing Sheets

Related U.S. Application Data

(60) Provisional application No. 62/339,580, filed on May 20, 2016.

(51) Int. Cl.

| | |
|---|---|
| ***C21D 1/26*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C21D 9/46*** | (2006.01) |
| ***C22C 38/24*** | (2006.01) |
| ***C22C 38/28*** | (2006.01) |
| ***C22C 38/00*** | (2006.01) |
| ***C22C 38/06*** | (2006.01) |
| ***C22C 38/26*** | (2006.01) |

(52) U.S. Cl.

CPC ..... *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *C22C 38/24* (2013.01); *C22C 38/26* (2013.01); *C22C 38/28* (2013.01); *C23C 10/20* (2013.01); *C21D 2211/001* (2013.01); *C21D 2211/005* (2013.01)

(56) References Cited

U.S. PATENT DOCUMENTS

| | | | |
|---|---|---|---|
| 2,749,029 | A | 6/1956 | Goetzel et al. |
| 2,794,630 | A | 6/1957 | Turner, Jr. |
| 2,836,513 | A | 5/1958 | Samuel |
| 2,859,158 | A | 11/1958 | Schaer |
| 3,066,403 | A | 12/1962 | Brauchler |
| 3,165,823 | A | 1/1965 | Rowady |
| 3,184,331 | A | 5/1965 | Carter |
| 3,222,212 | A | 12/1965 | Samuel et al. |
| 3,294,498 | A | 12/1966 | Carter |
| 3,312,546 | A | 4/1967 | Mayer et al. |
| 3,403,988 | A | 10/1968 | Carter |
| 3,414,428 | A | 12/1968 | Kelly et al. |
| 3,604,102 | A | 9/1971 | Mario et al. |
| 3,615,902 | A | 10/1971 | Andrew |
| 3,642,517 | A | 2/1972 | Guy |
| 3,728,149 | A | 4/1973 | Forand et al. |
| 3,753,704 | A | 8/1973 | Manilla et al. |
| 3,753,758 | A | 8/1973 | Shanley |
| 3,762,884 | A | 10/1973 | Grisaffe et al. |
| 3,768,987 | A | 10/1973 | Forstmann et al. |
| 3,775,151 | A | 11/1973 | Baker et al. |
| 3,879,270 | A | 4/1975 | Kowalski |
| 3,902,892 | A | 9/1975 | Easwaran et al. |
| 3,935,034 | A | 1/1976 | Hayes et al. |
| 3,951,759 | A | 4/1976 | Studer |
| 3,959,089 | A | 5/1976 | Watts |
| 3,998,603 | A | 12/1976 | Rairden, III |
| 4,092,226 | A | 5/1978 | Laing et al. |
| 4,119,701 | A | 10/1978 | Fedor et al. |
| 4,162,758 | A | 7/1979 | Mikarai |
| 4,187,200 | A | 2/1980 | Jenkin |
| 4,319,121 | A | 3/1982 | Yoshida |
| 4,485,148 | A | 11/1984 | Rashid et al. |
| 4,500,364 | A | 2/1985 | Krutenat et al. |
| 4,526,148 | A | 7/1985 | Narasaka et al. |
| 4,526,817 | A | 7/1985 | Rausch et al. |
| 4,542,846 | A | 9/1985 | Matsui et al. |
| 4,610,772 | A | 9/1986 | Palnik |
| 4,835,010 | A | 5/1989 | Krutenat et al. |
| 4,837,091 | A | 6/1989 | Nickola |
| 4,904,501 | A | 2/1990 | Davis |
| 4,915,750 | A | 4/1990 | Salsgiver et al. |
| 4,917,969 | A | 4/1990 | Pircher et al. |
| 5,015,535 | A | 5/1991 | Marquez et al. |
| 5,021,301 | A | 6/1991 | Nakakoji et al. |
| 5,024,735 | A | 6/1991 | Kadija, I |
| 5,167,791 | A | 12/1992 | Herbert et al. |
| 5,366,765 | A | 11/1994 | Milaniak et al. |
| 5,413,646 | A | 5/1995 | Dash et al. |
| 5,833,838 | A | 11/1998 | Heyse et al. |
| 5,879,532 | A | 3/1999 | Foster et al. |
| 5,997,815 | A | 12/1999 | Anders et al. |
| 6,004,684 | A | 12/1999 | Sugg et al. |
| 6,087,019 | A | 7/2000 | Isobe et al. |
| 6,110,262 | A | 8/2000 | Kircher et al. |
| 6,139,649 | A | 10/2000 | Wynns |
| 6,143,424 | A | 11/2000 | Jonte et al. |
| 6,153,064 | A | 11/2000 | Condra et al. |
| 6,170,487 | B1 | 1/2001 | Ishiguro et al. |
| 6,176,992 | B1 | 1/2001 | Talieh |
| 6,196,936 | B1 | 3/2001 | Meckel |
| 6,228,445 | B1 | 5/2001 | Tverberg |
| 6,258,186 | B1 | 7/2001 | Choi |
| 6,296,805 | B1 | 10/2001 | Laurent et al. |
| 6,309,517 | B1 | 10/2001 | Condra et al. |
| 6,322,907 | B1 | 11/2001 | Hauser et al. |
| 6,328,872 | B1 | 12/2001 | Talieh et al. |
| 6,331,241 | B1 | 12/2001 | Ilgar |
| 6,352,235 | B2 | 3/2002 | Cizek |
| 6,372,374 | B1 | 4/2002 | Li et al. |
| 6,406,610 | B1 | 6/2002 | Lowe |
| 6,409,904 | B1 | 6/2002 | Uzoh et al. |
| 6,475,642 | B1 | 11/2002 | Zhao et al. |
| 6,475,645 | B1 | 11/2002 | Osman et al. |
| 6,497,920 | B1 | 12/2002 | Pfaendtner et al. |
| 6,548,192 | B2 | 4/2003 | Chen |
| 6,548,193 | B2 | 4/2003 | Chen |
| 6,551,722 | B2 | 4/2003 | Jonte et al. |
| 6,569,265 | B1 | 5/2003 | Anderson et al. |
| 6,706,416 | B1 | 3/2004 | Cacace |
| 6,720,088 | B2 | 4/2004 | Zhao et al. |
| 6,755,960 | B1 | 6/2004 | Frischauf et al. |
| 6,756,134 | B2 | 6/2004 | Hodgens et al. |
| 6,837,979 | B2 | 1/2005 | Uzoh et al. |
| 6,881,282 | B2 | 4/2005 | Dupuis et al. |
| 6,911,137 | B2 | 6/2005 | Van |
| 6,921,586 | B2 | 7/2005 | Zhao et al. |
| 7,166,323 | B2 | 1/2007 | Chung et al. |
| 7,407,717 | B2 | 8/2008 | Tietz et al. |
| 7,425,255 | B2 | 9/2008 | Detor et al. |
| 7,442,268 | B2 | 10/2008 | Sun |
| 7,553,517 | B1 | 6/2009 | Jablonski et al. |
| 7,842,400 | B2 | 11/2010 | Yamaji et al. |
| 7,879,160 | B2 | 2/2011 | Sun |
| 7,959,747 | B2 | 6/2011 | Sun |
| 8,123,967 | B2 | 2/2012 | Anton et al. |
| 8,273,235 | B2 | 9/2012 | Chapaneri et al. |
| 8,309,233 | B2 | 11/2012 | Facchini et al. |
| 8,337,643 | B2 | 12/2012 | Sun |
| 8,366,844 | B2 | 2/2013 | Sun |
| 8,367,217 | B2 | 2/2013 | Facchini et al. |
| 8,557,397 | B2 | 10/2013 | Bullard et al. |
| 8,608,875 | B1 | 12/2013 | Bullard et al. |
| 8,628,861 | B2 | 1/2014 | Bullard et al. |
| 8,784,997 | B2 | 7/2014 | Bullard et al. |
| 8,790,790 | B2 | 7/2014 | Bullard et al. |
| 8,795,447 | B2 | 8/2014 | Bullard et al. |
| 9,333,727 | B2 | 5/2016 | Bullard et al. |
| 10,876,198 | B2 | 12/2020 | McDermott et al. |
| 2002/0192494 | A1 | 12/2002 | Tzatzov et al. |
| 2002/0192590 | A1 | 12/2002 | Mase et al. |
| 2003/0064245 | A1 | 4/2003 | Vostrikov et al. |
| 2003/0178314 | A1 | 9/2003 | Polinski et al. |
| 2003/0190492 | A1 | 10/2003 | Wada et al. |
| 2004/0048977 | A1 | 3/2004 | Wilke et al. |
| 2005/0090016 | A1 | 4/2005 | Rich et al. |
| 2005/0095358 | A1 | 5/2005 | Park et al. |
| 2006/0257683 | A1 | 11/2006 | Polinski et al. |
| 2007/0009755 | A1 | 1/2007 | Ben et al. |
| 2007/0172693 | A1 | 7/2007 | Kumaki et al. |
| 2008/0076683 | A1 | 3/2008 | Okamoto et al. |
| 2008/0251389 | A1 | 10/2008 | Kingston |
| 2009/0028743 | A1 | 1/2009 | Gupta et al. |

(56) References Cited

U.S. PATENT DOCUMENTS

| | | | |
|---|---|---|---|
| 2009/0130410 | A1 | 5/2009 | Damasse et al. |
| 2010/0081006 | A1 | 4/2010 | Leidolf, Jr. et al. |
| 2010/0167087 | A1 | 7/2010 | Wijenberg et al. |
| 2010/0221574 | A1 | 9/2010 | Rochester |
| 2010/0243192 | A1 | 9/2010 | Balasubramanian et al. |
| 2010/0304179 | A1 | 12/2010 | Facchini et al. |
| 2011/0117384 | A1 | 5/2011 | Biswas et al. |
| 2011/0262764 | A1 | 10/2011 | Arai et al. |
| 2011/0269051 | A1 | 11/2011 | Wijenbergjacques et al. |
| 2011/0300454 | A1 | 12/2011 | Goller et al. |
| 2011/0308989 | A1 | 12/2011 | Berrux et al. |
| 2012/0052319 | A1 | 3/2012 | Sugawara et al. |
| 2012/0156366 | A1 | 6/2012 | Cetel et al. |
| 2012/0189868 | A1 | 7/2012 | Borovik et al. |
| 2013/0171471 | A1 | 7/2013 | Bullard et al. |
| 2013/0252022 | A1 | 9/2013 | Bullard et al. |
| 2013/0309410 | A1 | 11/2013 | Bullard et al. |
| 2014/0014236 | A1* | 1/2014 | Nozaki ..... C22C 38/001 148/504 |
| 2014/0037852 | A1 | 2/2014 | Bullard et al. |
| 2014/0037987 | A1 | 2/2014 | Bullard et al. |
| 2014/0079958 | A1 | 3/2014 | Bullard et al. |
| 2014/0106123 | A1 | 4/2014 | Tapia De La Fuente et al. |
| 2014/0238555 | A1 | 8/2014 | Funakawa et al. |
| 2014/0322555 | A1 | 10/2014 | Walter et al. |
| 2014/0345910 | A1 | 11/2014 | Wang et al. |
| 2015/0099095 | A1 | 4/2015 | Pershin et al. |
| 2015/0167131 | A1 | 6/2015 | Bullard et al. |
| 2015/0345041 | A1 | 12/2015 | Ilgar et al. |
| 2016/0010170 | A1 | 1/2016 | Thomas et al. |
| 2016/0230284 | A1 | 8/2016 | McDermott et al. |
| 2018/0023180 | A1 | 1/2018 | McDermott et al. |

FOREIGN PATENT DOCUMENTS

| | | | |
|---|---|---|---|
| CN | 1433486 | A | 7/2003 |
| CN | 1888139 | A | 1/2007 |
| DE | 2008664 | A1 | 9/1971 |
| DE | 2507242 | A1 | 9/1976 |
| DE | 3201641 | A1 | 7/1983 |
| DE | 10306649 | A1 | 9/2004 |
| EP | 0182964 | A1 | 6/1986 |
| EP | 0204318 | A2 | 12/1986 |
| EP | 0290836 | A2 | 11/1988 |
| EP | 0892088 | A2 | 1/1999 |
| EP | 1186680 | A2 | 3/2002 |
| EP | 1260598 | A1 | 11/2002 |
| EP | 1278899 | B1 | 6/2004 |
| EP | 1844176 | B1 | 4/2011 |
| EP | 2382336 | B1 | 3/2013 |
| GB | 1035827 | A | 7/1966 |
| GB | 1313545 | A | 4/1973 |
| GB | 1431355 | A | 4/1976 |
| GB | 1487352 | A | 9/1977 |
| JP | 4733244 | | 8/1972 |
| JP | S531162 | A | 1/1978 |
| JP | S57143489 | A | 9/1982 |
| JP | S58177459 | A | 10/1983 |
| JP | S58181860 | A | 10/1983 |
| JP | S59140392 | A | 8/1984 |
| JP | S59212143 | A | 12/1984 |
| JP | S60177176 | A | 9/1985 |
| JP | S60230995 | A | 11/1985 |
| JP | S6179758 | A | 4/1986 |
| JP | S62297491 | A | 12/1987 |
| JP | S63499 | A | 1/1988 |
| JP | S6487761 | A | 3/1989 |
| JP | H01195268 | A | 8/1989 |
| JP | H02274866 | A | 11/1990 |
| JP | H03197693 | A | 8/1991 |
| JP | H0472091 | A | 3/1992 |
| JP | H07310166 | A | 11/1995 |
| JP | H07310167 | A | 11/1995 |
| JP | 2691828 | B2 | 12/1997 |
| JP | H1060527 | A | 3/1998 |
| JP | H10226873 | A | 8/1998 |
| JP | 2009062590 | A | 3/2009 |
| JP | 2011116584 | A | 6/2011 |
| KR | 950014333 | A | 6/1995 |
| WO | WO-9104346 | A1 | 4/1991 |
| WO | WO-2010053729 | A1 | 5/2010 |
| WO | WO-2010075998 | A2 | 7/2010 |
| WO | WO-2011121121 | A2 | 10/2011 |
| WO | WO-2013101574 | A1 | 7/2013 |
| WO | WO-2013172911 | | 11/2013 |
| WO | WO-2014051683 | A1 | 4/2014 |
| WO | WO-2014138027 | A1 | 9/2014 |
| WO | WO-2015006330 | A1 | 1/2015 |
| WO | WO-2015070130 | A1 | 5/2015 |
| WO | WO-2015089097 | A1 | 6/2015 |
| WO | WO-2015147301 | A1 | 10/2015 |
| WO | WO-2016130548 | A1 | 8/2016 |
| WO | WO-2017156069 | A1 | 9/2017 |
| WO | WO-2017201418 | A1 | 11/2017 |
| WO | WO-2018013863 | A1 | 1/2018 |

OTHER PUBLICATIONS

PCT/US14/20226 International Search Report and Written Opinion dated Jun. 12, 2014.

EP2382336B1 (EP Application No. 09795725.2) Opposition dated Dec. 16, 2013.

U.S. Appl. No. 14/068,153 Office Action dated Nov. 5, 2015.

U.S. Appl. No. 14/068,153 Notice of Allowance dated Feb. 18, 2016.

U.S. Appl. No. 13/142,307 Office Action dated Jul. 31, 2014.

U.S. Appl. No. 14/068,153 Office Action dated Jun. 19, 2015.

U.S. Appl. No. 13/142,307 Office Action dated Jan. 24, 2014.

U.S. Appl. No. 15/673,107 Office Action dated Apr. 18, 2019.

Abstract for CN201850703, Jun. 2011.

Abstract for CN202381968, Aug. 2012.

American Galvanizers Association, "The HDG Coating," available at: galvanizeit.org/about-hot-dip-galvanizing/what-is-hot-dip-galvanizing/the-hdg-coating (retrieved Aug. 12, 2013).

Bramfitt, B. L. "ASM Handbooks Online." Heat Treating vol. 4. ASM International, 1991. Web. Jul. 24, 2013.<http://products.asminternational.org/hbk/index.jsp>.<http:></http:>.

Braun, et al. Diffusion of chromium in alpha-iron. Phys. Stat. Sol. (a), 1985, pp. 553-561, vol. 90/2.

Castle, et al. Chromium diffusion coatings. International Materials Review, 1999, 44(2): 37-59; ASM International, USA.

Co-pending U.S. Appl. No. 16/121,280, filed Sep. 4, 2018.

Co-pending U.S. Appl. No. 16/245,729, filed Jan. 11, 2019.

Davies, et al. The diffusion of chromium in iron and low carbon steels. Acta Metallurgica, 1967, pp. 1799-1804, vol. 15.

European search report and search opinion dated Mar. 27, 2017 for EP Application No. 14869172.8.

Gupta, et al. Experimental and theoretical concentration profiles at the surface of chromized iron. Metallurgical Trans. (A), 1982, pp. 495-497, vol. 13A.

Hudson, R. M. "Pickling and Descaling". Surface Engineering, vol. 5. ASM Handbook, ASM International. 1994. pp. 67-78.

International preliminary report on patentability dated Jun. 29, 2011 for PCT Application No. PCT/EP2009/009246.

International search report and written opinion dated Feb. 8, 2013 for PCT Application No. US2012/070469.

International search report and written opinion dated Mar. 31, 2015 for PCT Application No. PCT/US2014/069383.

International search report and written opinion dated Jun. 3, 2016 for PCT Application No. PCT/US2016/017155.

International search report and written opinion dated Aug. 19, 2013 for PCT Application No. US2013/030902.

International Search Report and Written Opinion of the International Searching Authority PCT/US2013/027725, dated Apr. 15, 2013.

International search report dated Aug. 9, 2010 for PCT Application No. PCT/EP2009/009246.

(56) References Cited

OTHER PUBLICATIONS

Kawamura, et al. Determination of surface chroium contents of chromized steel by fluorescent x-ray analysis. Transactions of the Japan Institute of Metals, 1969, 10:267-270.
Leferink, et al. Chromium diffusion coatings on low-alloyed steels for corrosion protection under sulphidizing conditions. VGB Kraftwerkstecknick, 1993, pp. 1014, vol. 73/3.
Machine translation of DE 2507242 A published Sep. 1975.
Machine translation of JP 2009-062590 A by Yamada, Eiko published Mar. 2009.
Meier, et al. Diffusion chromizing of ferrous alloys. Surface and coating technology, 1989, 29/40; 53-64.
Notice of allowance dated May 22, 2014 for U.S. Appl. No. 14/052,712.
Notice of allowance dated Jun. 6, 2014 for U.S. Appl. No. 14/052,709.
Notice of allowance dated Jun. 11, 2014 for U.S. Appl. No. 14/052,710.
Notice of allowance dated Jun. 24, 2014 for U.S. Appl. No. 14/052,712.
Notice of allowance dated Sep. 3, 2013 for U.S. Appl. No. 13/629,699.
Notice of allowance dated Sep. 30, 2013 for U.S. Appl. No. 13/800,698.
Notice of Allowance dated Oct. 16, 2013 for U.S. Appl. No. 13/776,941.
Office action dated Jan. 15, 2014 for U.S. Appl. No. 14/052,709.
Office action dated Jan. 17, 2014 for U.S. Appl. No. 14/052,712.
Office action dated Jan. 22, 2014 for U.S. Appl. No. 14/052,710.
Office action dated Mar. 6, 2013 for U.S. Appl. No. 13/629,699.
Office action dated Mar. 23, 2017 for U.S. Appl. No. 14/565,216.
Office action dated Mar. 31, 2017 for U.S. Appl. No. 15/019,887.
Office action dated May 21, 2013 for U.S. Appl. No. 13/629,699.
Office action dated May 22, 2014 for U.S. Appl. No. 14/052,709.
Office action dated May 31, 2016 for U.S. Appl. No. 15/019,887.
Office action dated Jul. 29, 2013 for U.S. Appl. No. 13/800,698.
Office action dated Jul. 31, 2013 for U.S. Appl. No. 13/776,941.
Office action dated Sep. 6, 2016 for U.S. Appl. No. 15/019,887.
Office action dated Sep. 19, 2017 for U.S. Appl. No. 14/716,358.
Office action dated Sep. 19, 2013 for U.S. Appl. No. 13/776,941.
PCT/US2017/021281 International Search Report and Written Opinion dated May 10, 2017.
PCT/US2017/033559 International Search Report and Written Report dated Jul. 11, 2017.
PCT/US2017/042012 International Search Report and Written Opinion dated Oct. 24, 2017.
Philippe, et al. Electroplating of stainless steel. Chem. Mater., 2008, 20, 3377-3384.
Piwonka, Thomas S. "Foundry Practice for Ferrous Alloys". Metals Handbook Desk Edition, 2nd edition. 1998.
Pollock, et al. Nickel-based superalloys for advanced turbine engines: chemistry, microstructure and properties. Journal of propulsion and power 22.2 (2006): 361-374.
Rao, V. "Powder Metallurgy" in manufacturing science and technology—manufacturing processes and machine tools. New Age International LTD, New Delhi, 2002, ISBN 81-224-1364-1.
Schubert, G. Electron Beam Welding—Process, Application and Equipment. PTR-Precision Technologies Inc., http://www.ptreb.com, published Nov. 30, 2010, downloaded Mar. 21, 2014.
Sponge iron. (n.d.). Dictionary.com Unabridged. Retrieved Jul. 24, 2013, from Dictionary.com website: http://dictionary.reference.com/browse/Sponge-iron.
U.S. Appl. No. 14/565,216 Office Action dated Dec. 27, 2017.
U.S. Appl. No. 15/673,107 Office Action dated Jul. 2, 2018.
Viswanathan, et al. Occlusion Plating of Nickel/Graphite Composites. Metal Finishing. Oct. 1979;77(10):67-9.
Wang, et al. Chromizing behaviors of a low carbon steel processed by means of surface mechanical attrition treatment. Acta Materialia, 2005, 53, 2081-2089.
Wisti, et al. Heat Treating vol. 4. ASM Handbooks Online. ASM Handbook, 1991. Web. Jul. 24, 2013.
Yamashita, T. Microstructure of Austenitic stainless Steel Explosively Bonded to low Carbon-Steel. J. Electron Microsc. (Tokyo), 1973, 22-1, 13-18.
Zamani, et al. Explosive welding of stainless steel-carbon steel coaxial pipes. J. Mat. Sci., 2012, 47-2, 685-695.
Zhang, et al. Interface fracture behavior of electroplated coating on metal substrate under compressive strain. J. Materials Processing Tech., 2009, pp. 1337-1341, vol. 209.
Co-pending U.S. Appl. No. 17/100,298, inventors McDermott; Joseph E. et al., filed Nov. 20, 2020.
EP17763960.6 The Extended European Search Report dated Oct. 15, 2019.
EP17828499.8 The Extended European Search Report dated Jun. 25, 2020.
EP17828499.8 The Partial Supplemental European Search Report dated Feb. 21, 2020.
PCT/US2020/018243 International Search Report dated Jun. 26, 2020.
PCT/US2021/015894 International Search Report and Written Opinion dated May 24, 2021.
U.S. Appl. No. 15/673,107 Notice of Allowance dated Sep. 3, 2020.
U.S. Appl. No. 16/121,280 Office Action dated Mar. 30, 2021.
U.S. Appl. No. 16/245,729 Office Action dated Jul. 21, 2020.
U.S. Appl. No. 16/245,729 Office Action dated Mar. 11, 2020.
U.S. Appl. No. 16/245,729 Office Action dated Mar. 30, 2021.
U.S. Appl. No. 15/673,107 Office Action dated Nov. 25, 2019.

* cited by examiner

METHODS AND SYSTEMS FOR COATING A STEEL SUBSTRATE

CROSS-REFERENCE

This application is a continuation of PCT International Application No. PCT/US2017/033559, filed May 19, 2017, which claims priority to U.S. Provisional Patent Application Ser. No. 62/339,580, filed May 20, 2016, each of which applications is incorporated herein by reference for all purposes.

BACKGROUND

Steel can be an alloy of iron and other elements, including carbon. When carbon is the primary alloying element, its content in the steel may be from about 0.002% to 2.1% by weight. Without limitation, the following elements can be present in steel: carbon, manganese, phosphorus, sulfur, silicon, oxygen, nitrogen, and aluminum. Alloying elements added to modify the characteristics of steel can include without limitation: manganese, nickel, chromium, molybdenum, boron, titanium, vanadium and niobium.

Stainless steel can be a material that does not readily corrode, rust (or oxidize) or stain with water. There can be different grades and surface finishes of stainless steel to suit a given environment. Stainless steel can be used where both the properties of steel and resistance to corrosion are beneficial.

SUMMARY

The present disclosure provides systems and methods for depositing a metal layer adjacent to a substrate. The substrate may be a steel substrate. Examples of such metal layers include, but are not limited to, stainless steel, silicon steel, and noise vibration harshness damping steel. Such substrates can include, for example, one or more of iron, chromium, nickel, silicon, vanadium, titanium, boron, tungsten, aluminum, molybdenum, cobalt, manganese, zirconium, and niobium, oxides thereof, nitrides thereof, sulfides thereof, or any combination thereof. Systems and substrates may generate desired resulting microstructures.

In an aspect, the present disclosure provides a method for forming at least one metal layer adjacent to a substrate, comprising: providing the substrate having a grain size that is from about 1 International Association for Testing and Materials (ASTM) to 30 ASTM, wherein the substrate has an austenite to ferrite ratio of at least 1 as measured by x-ray diffraction spectroscopy, and wherein the substrate includes at least two of (i) carbon at less than or equal to about 0.1 wt %, (ii) manganese from about 0.1 wt % to 3 wt %, (iii) silicon at less than or equal to about 1 wt %, (iv) vanadium at less than or equal to about 0.1 wt %, and (v) titanium at less than or equal to about 0.5 wt %; depositing a metal-containing layer adjacent to the substrate; annealing the substrate and the at least one metal-containing layer at an annealing temperature greater than 25° C. for an annealing time of at least about 1 second, thereby forming the at least one metal layer adjacent to the substrate, wherein the at least one metal layer has a grain size from about 1 ASTM to 30 ASTM. The substrate may be a low carbon, silicon, vanadium, and/or titanium content substrate. The substrate may have low, substantially low, or no detectable amount of carbon, silicon, vanadium, and/or titanium. In some embodiments, the substrate includes at least three of (i) carbon at less than or equal to about 0.1 wt %, (ii) about 0.1 wt % to 3 wt % manganese, (iii) silicon at less than or equal to about 1 wt %, (iv) vanadium at less than or equal to about 0.1 wt %, and (v) titanium at less than or equal to about 0.5 wt %. In some embodiments, the substrate includes at least four of (i) carbon at less than or equal to about 0.1 wt %, (ii) about 0.1 wt % to 3 wt % manganese, (iii) silicon at less than or equal to about 1 wt %, (iv) vanadium at less than or equal to about 0.1 wt %, and (v) titanium at less than or equal to about 0.5 wt %. In some embodiments, the substrate includes carbon at less than or equal to about 0.2 wt %. In some embodiments, the substrate includes carbon at less than or equal to about 0.1 wt %. In some embodiments, the substrate includes carbon at less than or equal to about 0.05 wt %. In some embodiments, the substrate includes about 0.1 wt % to about 2 wt % manganese. In some embodiments, the substrate includes about 0.2 wt % to about 1.5 wt % manganese. In some embodiments, the substrate includes about 0.5 wt % to about 0.7 wt % manganese. In some embodiments, the substrate includes about 1 wt % to about 1.5 wt % manganese.

In some embodiments, the substrate includes niobium at less than or equal to about 0.1 wt %. In some embodiments, the substrate includes niobium at less than or equal to about 0.05 wt %. In some embodiments, the substrate includes niobium at less than or equal to about 0.01 wt %. In some embodiments, the substrate includes at least about 0.01 wt % niobium. In some embodiments, the substrate includes at least about 0.05 wt % niobium.

In some embodiments, the substrate includes vanadium at less than or equal to about 0.1 wt %. In some embodiments, the substrate includes vanadium at less than or equal to about 0.05 wt %. In some embodiments, the substrate includes vanadium at less than or equal to about 0.01 wt %. In some embodiments, the substrate includes titanium at less than or equal to about 0.5 wt %. In some embodiments, the substrate includes titanium at less than or equal to about 0.3 wt % titanium. In some embodiments, the substrate includes titanium at less than or equal to about 0.15 wt %. In some embodiments, the substrate includes titanium at more than or equal to about 0.01 wt %. In some embodiments, the substrate includes titanium at more than or equal to about 0.015 wt %.

In some embodiments, the substrate includes about 0.001 wt % to about 0.01 wt % phosphorus. In some embodiments, the substrate includes about 0.0001 wt % to about 0.01 wt % sulfur. In some embodiments, the substrate includes about 0.001 wt % to about 0.1 wt % aluminum. In some embodiments, the substrate includes about 0.001 wt % to about 0.2 wt % copper. In some embodiments, the substrate includes about 0.01 wt % to about 0.1 wt % copper.

In some embodiments, the substrate includes about 0.001 wt % to about 0.1 wt % nickel. In some embodiments, the substrate includes about 0.01 wt % to about 0.08 wt % nickel. In some embodiments, the substrate includes about 0.02 wt % to about 0.07 wt % nickel. In some embodiments, the substrate includes about 0.001 wt % to about 0.1 wt % chromium. In some embodiments, the substrate includes about 0.01 wt % to about 0.06 wt % chromium. In some embodiments, the substrate includes about 0.001 wt % to about 0.1 wt % molybdenum. In some embodiments, the substrate includes about 0.001 wt % to about 0.05 wt % molybdenum. In some embodiments, the substrate includes about 0.0001 wt % to about 0.01 wt % tin. In some embodiments, the substrate includes about 0.005 wt % to about 0.01 wt % tin. In some embodiments, the substrate includes boron at less than or equal to about 0.001 wt %. In some embodiments, the substrate includes calcium at less than or equal to about 0.01 wt %. In some embodiments, the substrate includes calcium at less than or equal to about 0.005 wt %. In some embodiments, the substrate includes arsenic at less than or equal to about 0.01 wt %. In some embodiments, the substrate includes arsenic at less than or equal to about 0.001 wt %.

In some embodiments, the substrate includes about 0.0001 wt % to about 0.001 wt % cobalt. In some embodiments, the substrate includes lead at less than or equal to about 0.01 wt %. In some embodiments, the substrate includes lead at less than or equal to about 0.005 wt %. In some embodiments, the substrate includes about 0.0001 wt % to about 0.01 wt % antimony. In some embodiments, the substrate includes about 0.0001 wt % to about 0.01 wt % tantalum. In some embodiments, the substrate includes about 0.0001 wt % to about 0.01 wt % tungsten. In some embodiments, the substrate includes about 0.0001 wt % to about 0.05 wt % zinc. In some embodiments, the substrate includes about 0.0001 wt % to about 0.01 wt % zinc. In some embodiments, the substrate includes zirconium at less than or equal to about 0.006 wt %. In some embodiments, the substrate includes nitrogen at less than or equal to about 0.01 wt %. In some embodiments, the substrate includes nitrogen at less than or equal to about 0.005 wt %. In some embodiments, the substrate includes titanium nitride.

In some embodiments, the depositing is by vapor deposition. In some embodiments, the depositing is by electrochemical deposition. In some embodiments, the depositing is by slurry deposition. In some embodiments, the depositing is at a temperature from about 0° C. to 1000° C. In some embodiments, the depositing is at a temperature from about 10° C. to 100° C. In some embodiments, the depositing is at a temperature from about 1500° C. to 2000° C. In some embodiments, the depositing occurs in an atmosphere with levels of moisture below about 10 torr. In some embodiments, the depositing occurs in an atmosphere with levels of oxygen below about 0.01 torr.

In some embodiments, the depositing occurs in an atmosphere with levels of hydrogen below about 5%. In some embodiments, the method further comprises heating at a rate of about 0.1° C. per second. In some embodiments, the annealing is at a temperature above about 500° C. In some embodiments, the annealing is at a temperature above about 900° C. In some embodiments, the annealing is from about 1 hour to about 100 hours. In some embodiments, the annealing is from about 5 hours to about 50 hours. In some embodiments, the annealing is from about 10 hours to about 20 hours. In some embodiments, the method further comprises cooling of the substrate after the annealing. In some embodiments, the cooling is from about 1 hour to about 100 hours. In some embodiments, the cooling is from about 5 hours to about 50 hours. In some embodiments, the cooling is from about 10 hours to about 20 hours. In some embodiments, the substrate transitions from ferrite to austenite during the heating. In some embodiments, the heating temperature is determined by a transition temperature at which ferrite transitions to austenite. In some embodiments, the addition of at least one austenite stabilizer lowers the transition temperature. In some embodiments, the at least one austenite stabilizer is chosen from the group consisting of manganese, nitrogen, copper and gold.

In some embodiments, the at least one metal layer adjacent to the substrate has a ferrite grain size from about ASTM 1 to about ASTM 30. In some embodiments, the at least one metal layer adjacent to the substrate has a ferrite grain size from about ASTM 2 to about ASTM 20. In some embodiments, the at least one metal layer adjacent to the substrate has a ferrite grain size from about ASTM 4 to about ASTM 10. In some embodiments, the at least one metal layer adjacent to the substrate has a ferrite grain size from about ASTM 7 to about ASTM 10. In some embodiments, the method comprises repeating the annealing step. In some embodiments, the method further comprises drying the substrate. In some embodiments, the drying occurs in a near-vacuum atmosphere. In some embodiments, the drying occurs in an atmosphere of an inert gas. In some embodiments, the inert gas is hydrogen, helium, argon, nitrogen, or any combination thereof. In some embodiments, the at least one metal-containing layer comprises an alloying agent, a metal halide activator, and a solvent.

In some embodiments, the alloying agent is selected from ferrosilicon (FeSi), ferrochrome (FeCr), chromium, and combinations thereof. In some embodiments, the metal halide activator includes a monovalent metal, a divalent metal or a trivalent metal. In some embodiments, the metal halide activator is selected from the group consisting of magnesium chloride ($MgCl_2$), iron (II) chloride ($FeCl_2$), calcium chloride ($CaCl_2$), zirconium (IV) chloride ($ZrCl_4$), titanium (IV) chloride ($TiCl_4$), niobium (V) chloride ($NbCl_5$), titanium (III) chloride ($TiCl_3$), silicon tetrachloride ($SiCl_4$), vanadium (III) chloride ($VCl_3$), chromium (III) chloride ($CrCl_3$), trichlorosilance (SiHCl3), manganese (II) chloride ($MnCl_2$), chromium (II) chloride ($CrCl_2$), cobalt (II) chloride ($CoCl_2$), copper (II) chloride ($CuCl_2$), nickel (II) chloride ($NiCl_2$), vanadium (II) chloride ($VCl_2$), ammonium chloride ($NH_4Cl$), sodium chloride (NaCl), potassium chloride (KCl), molybdenum sulfide (MoS), manganese sulfide (MnS), iron disulfide ($FeS_2$), chromium sulfide (CrS), iron sulfide (FeS), copper sulfide (CuS), nickel sulfide (NiS) and combinations thereof.

In some embodiments, the solvent is an aqueous solvent. In some embodiments, the solvent is an organic solvent. In some embodiments, the at least one metal layer comprises an alloying agent and a metal halide activator. In some embodiments, the alloying agent is selected from ferrosilicon (FeSi), ferrochrome (FeCr), chromium, and combinations thereof. In some embodiments, the metal halide activator includes a monovalent metal, a divalent metal or a trivalent metal. In some embodiments, the metal halide activator is selected from the group consisting of magnesium chloride ($MgCl_2$), iron (II) chloride ($FeCl_2$), calcium chloride ($CaCl_2$), zirconium (IV) chloride ($ZrCl_4$), titanium (IV) chloride ($TiCl_4$), niobium (V) chloride ($NbCl_5$), titanium (III) chloride ($TiCl_3$), silicon tetrachloride ($SiCl_4$), vanadium (III) chloride ($VCl_3$), chromium (III) chloride ($CrCl_3$), trichlorosilance (SiHCl3), manganese (II) chloride ($MnCl_2$), chromium (II) chloride ($CrCl_2$), cobalt (II) chloride ($CoCl_2$), copper (II) chloride ($CuCl_2$), nickel (II) chloride ($NiCl_2$), vanadium (II) chloride ($VCl_2$), ammonium chloride ($NH_4Cl$), sodium chloride (NaCl), potassium chloride (KCl), molybdenum sulfide (MoS), manganese sulfide (MnS), iron disulfide ($FeS_2$), chromium sulfide (CrS), iron sulfide (FeS), copper sulfide (CuS), nickel sulfide (NiS) and combinations thereof.

In another aspect, the present disclosure provides a method for providing a steel substrate, comprising selecting the ferrite stabilizer such that a grain size of the steel substrate is about 7 per the International Association for Testing and Materials. In some embodiments, the substrate includes carbon at less than or equal to about 0.2 wt %. In some embodiments, the substrate includes carbon at less than or equal to about 0.1 wt %. In some embodiments, the substrate includes carbon at less than or equal to about 0.05 wt %. In some embodiments, the substrate includes about 0.1 wt % to about 2 wt % manganese. In some embodiments, the substrate includes about 0.2 wt % to about 1.5 wt % manganese. In some embodiments, the substrate includes about 0.5 wt % to about 0.7 wt % manganese. In some embodiments, the substrate includes about 1 wt % to about 1.5 wt % manganese. In some embodiments, the substrate includes niobium at less than or equal to about 0.1 wt %. In some embodiments, the substrate includes niobium at less than or equal to about 0.05 wt %. In some embodiments, the substrate includes niobium at less than or equal to about 0.01 wt %. In some embodiments, the substrate includes vanadium at less than or equal to about 0.1 wt %.

In some embodiments, the substrate includes vanadium at less than or equal to about 0.05 wt %. In some embodiments, the substrate includes vanadium at less than or equal to about 0.01 wt %. In some embodiments, the substrate includes titanium at less than or equal to about 0.5 wt %. In some embodiments, the substrate includes titanium at less than or equal to about 0.3 wt %. In some embodiments, the substrate includes titanium at less than or equal to about 0.1 wt %. In some embodiments, the substrate includes about 0.001 wt % to about 0.01 wt % phosphorus. In some embodiments, the substrate includes about 0.0001 wt % to about 0.01 wt % sulfur. In some embodiments, the substrate includes about 0.001 wt % to about 0.1 wt % aluminum. In some embodiments, the substrate includes about 0.001 wt % to about 0.2 wt % copper. In some embodiments, the substrate includes about 0.01 wt % to about 0.1 wt % copper. In some embodiments, the substrate includes about 0.01 wt % to about 0.08 wt % nickel. In some embodiments, the substrate includes about 0.001 wt % to about 0.1 wt % nickel. In some embodiments, the substrate includes about 0.01 wt % to about 0.08 wt % nickel. In some embodiments, the substrate includes about 0.001 wt % to about 0.1 wt % chromium. In some embodiments, the substrate includes about 0.01 wt % to about 0.06 wt % chromium. In some embodiments, the substrate includes about 0.001 wt % to about 0.1 wt % molybdenum. In some embodiments, the substrate includes about 0.001 wt % to about 0.05 wt % molybdenum.

In some embodiments, the substrate includes about 0.0001 wt % to about 0.01 wt % tin. In some embodiments, the substrate includes about 0.005 wt % to about 0.01 wt % tin. In some embodiments, the substrate includes boron at less than or equal to about 0.001 wt %. In some embodiments, the substrate includes calcium at less than or equal to about 0.01 wt %. In some embodiments, the substrate includes calcium at less than or equal to about 0.005 wt %. In some embodiments, the substrate includes arsenic at less than or equal to about 0.01 wt %. In some embodiments, the substrate includes arsenic at less than or equal to about 0.001 wt %. In some embodiments, the substrate includes about 0.0001 wt % to about 0.001 wt % cobalt.

In some embodiments, the substrate includes lead at less than or equal to about 0.01 wt %. In some embodiments, the substrate includes lead at less than or equal to about 0.005 wt %. In some embodiments, the substrate includes about 0.0001 wt % to about 0.01 wt % antimony. In some embodiments, the substrate includes about 0.0001 wt % to about 0.01 wt % tantalum. In some embodiments, the substrate includes about 0.0001 wt % to about 0.01 wt % tungsten. In some embodiments, the substrate includes about 0.0001 wt % to about 0.05 wt % zinc. In some embodiments, the substrate includes zirconium at less than about 0.006 wt %. In some embodiments, the substrate includes titanium nitride. In some embodiments, the ferrite-austenite transition temperature is less than about 1000° C.

In another aspect, the present disclosure provides a part or article comprising an inner core and an external metallic layer adjacent to the inner core, wherein the inner core comprises a substrate containing ferrite grains and the external metallic layer comprises a metal alloy, wherein the substrate comprises carbon at less than or equal to about 0.1 wt % as measured by X-ray Photoelectron Spectroscopy (XPS), and wherein the external metallic layer has a grain size that is from about 1 International Association for Testing and Materials (ASTM) to 30 ASTM. In some embodiments, the metal alloy comprises an alloying agent and a metal halide activator. In some embodiments, the alloying agent is selected from ferrosilicon (FeSi), ferrochrome (FeCr), chromium, and combinations thereof. In some embodiments, the metal halide activator includes a monovalent metal, a divalent metal or a trivalent metal. In some embodiments, the metal halide activator is selected from the group consisting of magnesium chloride ($MgCl_2$), iron (II) chloride ($FeCl_2$), calcium chloride ($CaCl_2$), zirconium (IV) chloride ($ZrCl_4$), titanium (IV) chloride ($TiCl_4$), niobium (V) chloride ($NbCl_5$), titanium (III) chloride ($TiCl_3$), silicon tetrachloride ($SiCl_4$), vanadium (III) chloride ($VCl_3$), chromium (III) chloride ($CrCl_3$), trichlorosilance (SiHCl3), manganese (II) chloride ($MnCl_2$), chromium (II) chloride ($CrCl_2$), cobalt (II) chloride ($CoCl_2$), copper (II) chloride ($CuCl_2$), nickel (II) chloride ($NiCl_2$), vanadium (II) chloride ($VCl_2$), ammonium chloride ($NH_4Cl$), sodium chloride (NaCl), potassium chloride (KCl), molybdenum sulfide (MoS), manganese sulfide (MnS), iron disulfide ($FeS_2$), chromium sulfide (CrS), iron sulfide (FeS), copper sulfide (CuS), nickel sulfide (NiS) and combinations thereof.

In some embodiments, the substrate includes at least two of (i) carbon at less than or equal to about 0.1 wt %, (ii) manganese from about 0.1 wt % to 3 wt %, (iii) silicon at less than or equal to about 1 wt %, (iv) vanadium at less than or equal to about 0.1 wt %, and (v) titanium at less than or equal to about 0.5 wt %. In some embodiments, the substrate includes at least three of (i) carbon at less than or equal to about 0.1 wt %, (ii) manganese from about 0.1 wt % to 3 wt %, (iii) silicon at less than or equal to about 1 wt %, (iv) vanadium at less than or equal to about 0.1 wt %, and (v) titanium at less than or equal to about 0.5 wt %. In some embodiments, the substrate includes at least four of (i) carbon at less than or equal to about 0.1 wt %, (ii) manganese from about 0.1 wt % to 3 wt %, (iii) silicon at less than or equal to about 1 wt %, (iv) vanadium at less than or equal to about 0.1 wt %, and (v) titanium at less than or equal to about 0.5 wt %. In some embodiments, the substrate has carbon at less than or equal to about 0.01% as measured by XPS. In some embodiments, the grain size is from about 3 ASTM to 15 ASTM.

INCORPORATION BY REFERENCE

All publications and patent applications mentioned in this specification are herein incorporated by reference to the same extent as if each individual publication or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings (also "figure" and "FIG." herein), of which:

DETAILED DESCRIPTION

Figure 1:
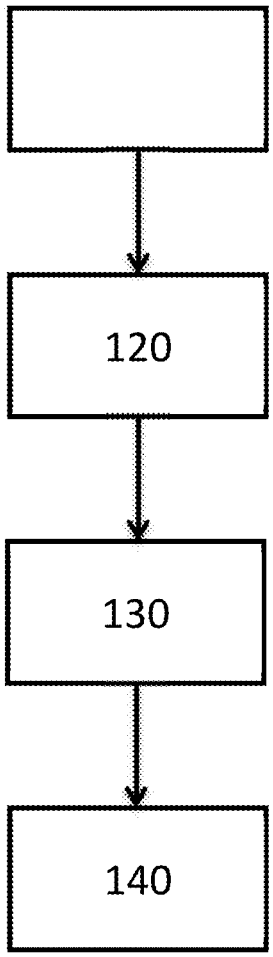
FIG. 1 illustrates a method for forming a metal layer adjacent to a substrate.

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

The term "slurry," as used herein, generally refers to a solution comprising a liquid phase and a solid phase. The solid phase may be in the liquid phase. A slurry may have one or more liquid phases and one or more solid phases.

The term "adjacent" or "adjacent to," as used herein, generally refers to 'next to', 'adjoining', 'in contact with,' and 'in proximity to.' In some instances adjacent to may be 'above' or 'below.' A first layer adjacent to a second layer may be in direct contact with the second layer, or there may be one or more intervening layers between the first layer and the second layer.

The present disclosure provides parts, articles, or objects (e.g., sheets, tubes or wires) coated with one or metal layers. A part may be at least a portion of an object or may be an entirety of the object. A metal layer may include one or more metals. In some cases, a substrate may be coated with a metal layer. The coating may comprise an alloying agent having at least one elemental metal. A slurry-coated substrate may be formed when a substrate is coated with a slurry comprising an alloying agent having at least one elemental metal. The substrate that has been coated with an alloying agent may be subjected to annealing conditions to yield a metal layer adjacent to the substrate. The metal layer may be coupled to a substrate with the aid of a diffusion layer between the metal layer and the substrate.

Substrates may generate an alloy layer of >50 microns while still retaining fine grains (>7 ASTM grain size) in the substrate. The grades developed and presented above are grades that may not be standard grades. The grades may be useful for high temperature annealing or high temperature applications not pertaining to metallizing processes.

Substrate and Slurry

The present disclosure provides substrates and methods that employ depositing metal layers adjacent to substrates. Such substrates can include, for example, one or more of the following elements: carbon, manganese, silicon, vanadium, titanium, nickel, chromium, molybdenum, boron, and niobium. Examples of substrates include but are not limited to stainless steel, silicon steel, and noise vibration harshness damping steel.

The substrate may be provided as a coil, coiled mesh, wire, pipe, tube, slab, mesh, dipped formed part, foil, plate, a wire rope, a rod, or a threaded rod where a screw pattern has been applied to any length or thickness of rod, a sheet, or a planar surface. For example, a sheet may have a thickness anywhere from 0.001 inches to 1 inch.

A substrate may comprise an elemental species that is a transition metal, a nonmetal element, or a metalloid. A substrate may comprise a transition metal. A substrate may comprise a nonmetal element. A substrate may comprise a metalloid. A substrate may comprise an elemental species selected from, for example, chromium, nickel, aluminum, silicon, vanadium, titanium, boron, tungsten, molybdenum, cobalt, manganese, zirconium, niobium, carbon, nitrogen, sulfur, oxygen, phosphorus, copper, tin, calcium, arsenic, lead, antimony, tantalum, zinc, or any combination thereof.

A substrate may comprise metal such as iron, copper, aluminum, or any combination thereof. The substrate may comprise an alloy of metals and/or non-metals. The alloy may include impurities. The substrate may comprise steel. The substrate may be a steel substrate. The substrate may comprise ceramic. The substrate may be devoid of free carbon. The substrate can be made from melt phase. The substrate may be in a cold reduced state, in a full hard state (e.g., not subjected to an annealing step after cold reduction), or in a hot rolled pickled state.

The present disclosure provides substrates coated with one or more metal layers. In some cases, a substrate may be coated with at least one metal layer. A substrate may be coated with at least 1, 2, 3, 4, 5, 6, 7, 8, 9, 10 or more metal layers. The coating may comprise an alloying agent having at least one elemental metal. The metal layer may be coupled to a substrate with the aid of a diffusion layer between the metal layer and the substrate.

A metal layer may have a thickness of greater than about 1 nanometer, 10 nanometers, 100 nanometers, 500 nanometers, 1 micron, 5 microns, 10 microns, 25 microns, 50 microns, 60 microns, 70 microns, 80 microns, 90 microns, or 100 microns. The thickness of the metal layer may be greater than a monoatomic layer. The thickness may be a multilayer.

A substrate may comprise at least 2, 3, 4, 5, 6, 7, 8, 9, 10, 15, 20, or more elemental species. A substrate may comprise at least two of the following elements: carbon, manganese, silicon, vanadium, and titanium. A substrate may comprise at least three of the following elements: carbon, manganese, silicon, vanadium, and titanium. A substrate may comprise at least four of the following elements: carbon, manganese, silicon, vanadium, and titanium.

A substrate may comprise multiple elements. A substrate may comprise carbon at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise manganese at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise niobium at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise vanadium at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise titanium at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.15 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %.

A substrate may comprise nitrogen at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.15 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %.

A substrate may comprise phosphorus at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise sulfur at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise aluminum at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise copper at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %.

A substrate may comprise nickel at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise chromium at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise molybdenum at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise tin at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %.

A substrate may comprise boron at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise calcium at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise arsenic at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise cobalt at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %.

A substrate may comprise lead at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise antimony at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise tantalum at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %.

A substrate may comprise tungsten at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. A substrate may comprise zinc at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 w %, 20 wt %, 30 wt %, or 40 wt %. A substrate may comprise zirconium at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %.

A substrate may comprise niobium at less than or equal to about 0.0001 wt %, 0.0005 wt %, 0.001 wt %, 0.002 wt %, 0.003 wt %, 0.004 wt %, 0.005 wt %, 0.01 wt %, 0.05 wt %, 0.1 wt %, 0.2 wt %, 0.3 wt %, 0.4 wt %, 0.5 wt %, 0.6 wt %, 0.7 wt %, 0.8 wt %, 0.9 wt %, 1 wt %, 1.1 wt %, 1.2 wt %, 1.3 wt %, 1.4 wt %, 1.5 wt %, 1.6 wt %, 1.7 wt %, 1.8 wt %, 1.9 wt %, 2 wt %, 2.5 wt %, 3 wt %, 5 wt %, 7 wt %, 10 wt %, 15 wt %, 20 wt %, 30 wt %, or 40 wt %. Niobium may be added to a substrate, so that the substrate may comprise niobium in an amount of at least about 0.0001 wt %, 0.0005 wt %, 0.001 wt %, 0.002 wt %, 0.003 wt %, 0.004 wt %, 0.005 wt %, 0.006 wt %, 0.007 wt %, 0.008 wt %, 0.009 wt %, 0.01 wt %, 0.02 wt %, 0.03 wt %, 0.04 wt %, 0.05 wt %, 0.06 wt %, 0.07 wt %, 0.08 wt %, 0.09 wt %, 0.1 wt %, or more. Without wishing to be bound by theory, niobium in a substrate may prevent chromium depletion in a substrate.

Titanium may be present in a substrate. A substrate may comprise titanium in an amount of at least about 0.0001 wt %, 0.0005 wt %, 0.001 wt %, 0.002 wt %, 0.003 wt %, 0.004 wt %, 0.005 wt %, 0.006 wt %, 0.007 wt %, 0.008 wt %, 0.009 wt %, 0.01 wt %, 0.015 wt %, 0.02 wt %, 0.03 wt %, 0.04 wt %, 0.05 wt %, 0.06 wt %, 0.07 wt %, 0.08 wt %, 0.09 wt %, 0.1 wt %, or more. In some cases, a substrate may comprise at least about 0.015 wt % titanium.

Figure 3:
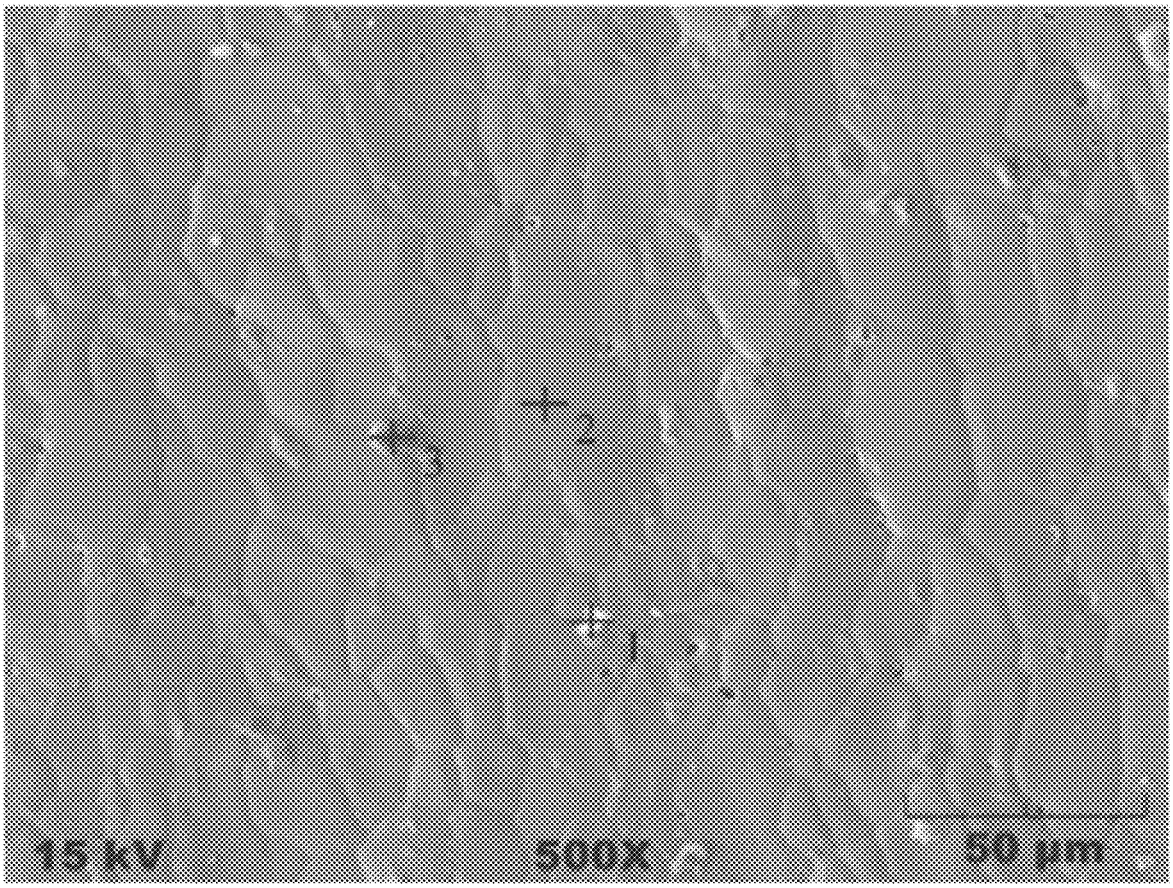
FIG. 3 illustrates a steel substrate after coating with a metal layer.

Free interstitials, such as nitrogen, carbon, and sulfur, may exist during formation of a substrate. Niobium in a substrate may bind to these free interstitials (e.g. nitrogen, carbon, and sulfur) in the substrate. Addition of niobium may prevent grain boundary precipitates, e.g. chromium grain boundary precipitates. A decrease in grain boundary precipitates may lead to an increase in corrosion performance, which may be a desired property of a substrate. FIG. 3 illustrates a steel substrate after coating with a metal layer, wherein no grain boundary chromium precipitates are observed.

The weight % of chromium on the surface of a substrate may be measured. The chromium weight % may be of a coated substrate or of an uncoated substrate. In some embodiments, the chromium weight % of a substrate may be greater than about 5%, 10%, 15%, 16%, 17%, 18%, 19%, 20%, 21%, 22%, 23%, 24%, 25%, or 26%. The chromium weight % of a substrate may be about 16%, 17%, 18%, 19%, 20%, 21%, 22%, or 23%. The chromium weight % of a coated substrate may be greater than, about, or less than the chromium weight % of an uncoated substrate.

Substrates may be purchased from a vendor. Substrates may be coated with a metal-containing layer the same day the substrate was prepared. Substrates may be prepared greater than about 2 days, 3 days, 1 week, 1 month, or 1 year before coating with a metal-containing layer.

The present disclosure provides methods for forming a metal layer adjacent to a substrate. The metal layer can be formed by application of a slurry adjacent to a substrate. Deposition of a slurry adjacent to a substrate may form a metal-containing layer adjacent to the substrate. In some embodiments, the slurry comprises an alloying agent, a metal halide activator and a solvent, and wherein the alloying agent comprises the metal.

In some embodiments, a metal-containing layer comprises carbon. In some embodiments, the metal-containing layer comprises one or more of iron, chromium, nickel, silicon, vanadium, titanium, boron, tungsten, aluminum, molybdenum, cobalt, manganese, zirconium, niobium and combinations thereof. In some embodiments, the alloying agent is selected from the group consisting of ferrosilicon (FeSi), ferrochrome (FeCr), chromium and combinations thereof.

In some embodiments, the metal halide activator includes a monovalent metal, a divalent metal or a trivalent metal. In some embodiments, the metal halide activator is selected from the group consisting of magnesium chloride ($MgCl_2$), iron (II) chloride ($FeCl_2$), calcium chloride ($CaCl_2$), zirconium (IV) chloride ($ZrCl_4$), titanium (IV) chloride ($TiCl_4$), niobium (V) chloride ($NbCl_5$), titanium (III) chloride ($TiCl_3$), silicon tetrachloride ($SiCl_4$), vanadium (III) chloride ($VCl_3$), chromium (III) chloride ($CrCl_3$), trichlorosilance (SiHCl3), manganese (II) chloride ($MnCl_2$), chromium (II) chloride ($CrCl_2$), cobalt (II) chloride ($CoCl_2$), copper (II) chloride ($CuCl_2$), nickel (II) chloride ($NiCl_2$), vanadium (II) chloride ($VCl_2$), ammonium chloride ($NH_4Cl$), sodium chloride (NaCl), potassium chloride (KCl), molybdenum sulfide (MoS), manganese sulfide (MnS), iron disulfide ($FeS_2$), chromium sulfide (CrS), iron sulfide (FeS), copper sulfide (CuS), nickel sulfide (NiS) and combinations thereof. In some embodiments, the halide activator is hydrated. In some embodiments, the halide activator is selected from the group consisting of iron chloride tetrahydrate ($FeCl_2.4H_2O$), iron chloride hexahydrate ($FeCl_2.6H_2O$) and magnesium chloride hexahydrate ($MgCl_2.6H_2O$). In some embodiments, the halide activator is hydrated. In some embodiments, the halide activator is selected from the group consisting of iron chloride tetrahydrate ($FeCl_2.4H_2O$), iron chloride hexahydrate ($FeCl_2.6H_2O$) and magnesium chloride hexahydrate ($MgCl_2.6H_2O$).

In some embodiments, a metal layer is formed adjacent to a substrate after a metal-containing layer is annealed to a substrate. In some embodiments, a metal layer comprises carbon. In some embodiments, the metal layer comprises one or more of iron, chromium, nickel, silicon, vanadium, titanium, boron, tungsten, aluminum, molybdenum, cobalt, manganese, zirconium, niobium and combinations thereof. In some embodiments, the alloying agent is selected from the group consisting of ferrosilicon (FeSi), ferrochrome (FeCr), chromium and combinations thereof.

In some embodiments, a metal layer contains a monovalent metal, a divalent metal or a trivalent metal. In some embodiments, a metal layer contains a metal selected from the group consisting of magnesium chloride ($MgCl_2$), iron (II) chloride ($FeCl_2$), calcium chloride ($CaCl_2$), zirconium (IV) chloride ($ZrCl_4$), titanium (IV) chloride ($TiCl_4$), niobium (V) chloride ($NbCl_5$), titanium (III) chloride ($TiCl_3$), silicon tetrachloride ($SiCl_4$), vanadium (III) chloride ($VCl_3$), chromium (III) chloride ($CrCl_3$), trichlorosilance (SiHCl3), manganese (II) chloride ($MnCl_2$), chromium (II) chloride ($CrCl_2$), cobalt (II) chloride ($CoCl_2$), copper (II) chloride ($CuCl_2$), nickel (II) chloride ($NiCl_2$), vanadium (II) chloride ($VCl_2$), ammonium chloride ($NH_4Cl$), sodium chloride (NaCl), potassium chloride (KCl), molybdenum sulfide (MoS), manganese sulfide (MnS), iron disulfide ($FeS_2$), chromium sulfide (CrS), iron sulfide (FeS), copper sulfide (CuS), nickel sulfide (NiS) and combinations thereof. In some embodiments, the halide activator is hydrated. In some embodiments, the halide activator is selected from the group consisting of iron chloride tetrahydrate ($FeCl_2.4H_2O$), iron chloride hexahydrate ($FeCl_2.6H_2O$) and magnesium chloride hexahydrate ($MgCl_2.6H_2O$). In some embodiments, the metal is hydrated. In some embodiments, the metal is selected from the group consisting of iron chloride tetrahydrate ($FeCl_2.4H_2O$), iron chloride hexahydrate ($FeCl_2.6H_2O$) and magnesium chloride hexahydrate ($MgCl_2.6H_2O$).

A slurry may comprise a solvent. The boiling point (or boiling temperature) of the solvent may be less than or equal to about 200° C., 190° C., 180° C., 170° C., 160° C., 150° C., 140° C., 130° C., 120° C., 110° C., or 100° C.

In some embodiments, the slurry comprises an inert species. A slurry may be formed by mixing various components in a mixing chamber (or vessel). Various components may be mixed at the same time or sequentially. For example, a solvent is provided in the chamber and an elemental species is subsequently added to the chamber. To prevent clumping, dry ingredients may be added to the solvent in controlled amounts. Some elemental metals may be in dry powder form.

The blade used to mix the metal-containing layer components may be in the shape of a whisk, a fork, or a paddle. More than one blade may be used to mix the slurry components. Each blade may have different shapes or the same shape. Dry ingredients may be added to the solvent in controlled amounts to prevent clumping. A high shear rate may be needed to help control viscosity. In a slurry, chromium particles may be larger in size than other particles, and may be suspended without high polymer additions.

The properties of the slurry can be a function of one or more parameters used to form the slurry, maintain the slurry or deposit the slurry. Such properties can include viscosity, shear thinning index, and yield stress. Such properties can include Reynolds number, viscosity, pH, and slurry component concentration. Parameters that can influence properties of the slurry can include water content, elemental species identity and content, temperature, shear rate and time of mixing.

FIG. 1 illustrates a method of forming a metal layer adjacent to a substrate. In operation 110, a metal composition is provided. Next, in operation 120, the slurry can be applied from the mixing vessel to the substrate to form a metal layer. In operation 130, the solvent in the slurry is removed after application by heat or vacuum drying at 90° C.-175° C. for 10-60 seconds. In operation 140, the web or substrate material is rolled or otherwise prepared for thermal treatment. In operation 150, a metal layer is annealed adjacent to the substrate.

Figure 2:
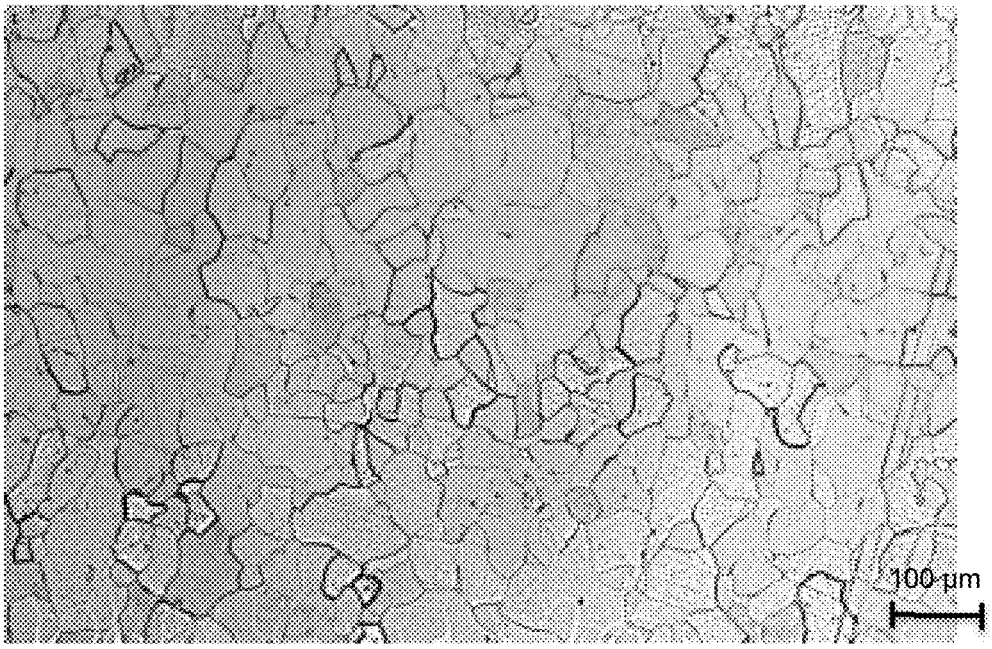
FIG. 2 illustrates a steel substrate after coating with a metal layer.

FIG. 2 illustrates an image of a steel substrate after coating with a metal layer. The grain size and coefficient of variation may be calculated according to the American Society of the International Association for Testing and Materials (ASTM) standard.

The slurry may exhibit thixotropic behavior, wherein the slurry exhibits a decreased viscosity when subjected to sheer strain. The shear thinning index of the slurry can be from about 1 to about 8. In order to achieve the target viscosity, mixing may occur at a high shear rate. The shear rate can be from about 1 $s^{-1}$ to about 10,000 $s^{-1}$ (or Hz). The shear rate may be about 1 $s^{-1}$, about 10 $s^{-1}$, about 100 $s^{-1}$, about 1,000 $s^{-1}$, about 5,000 $s^{-1}$, or about 10,000 $s^{-1}$.

The shear rate of a slurry may be measured on various instruments. The shear rate may be measured on a TA Instruments DHR-2 rheometer, for example. The shear rate of a slurry may differ depending on the instrument used to perform the measurement.

In order to achieve the target or predetermined viscosity, mixing may occur for a period of time from 1 minute to 2 hours. The time of mixing may be less than 30 minutes. The viscosity of the slurry may decrease the longer the slurry is mixed. The time of mixing may correspond to the length of time needed to homogenize the slurry.

A properly mixed state may be a state where the slurry does not have water on the surface. A properly mixed state may be a state where there are no solids on the bottom of the vessel. The slurry may appear to be uniform in color and texture.

The desired viscosity of the metal-containing layer can be a viscosity that is suitable for roll coating. The viscosity of the slurry can be from about 1 centipoise (cP) to 5,000,000 cP. The viscosity of the slurry may be about 1 cP, about 5 cP, about 10 cP, about 50 cP, about 100 cP, about 200 cP, about 500 cP, about 1,000 cP, about 10,000 cP, about 100,000 cP, about 1,000,000 cP, or about 5,000,000 cP. The viscosity of the slurry may be from about 1 cP to 1,000,000 cP, or 100 centipoise cP to 100,000 cP. The viscosity of the slurry may depend on shear rate. The viscosity of the slurry may be from about 200 cP to about 10,000 cP, or about 600 cP to about 800 cP. The slurry may be from 100 cP to 200 cP in the application shear window that has shear rates from 1000 $s^{-1}$ to 1000000 $s^{-1}$. The capillary number of the slurry may be from about 0.01 to 10. The yield stress of a slurry may be from about 0 to 1 Pa.

The settling rate of the slurry may be stable to separation or sedimentation for greater than one minute, greater than 15 minutes, greater than 1 hour, greater than 1 day, greater than 1 month, or greater than 1 year. The settling rate of the slurry may refer to the amount of time the slurry is able to withstand, without mixing, before settling occurs, or before the viscosity increases to values that are not suitable for roll coating. Similarly, the shelf-life of the slurry may refer to the time that slurry can withstand, without mixing, before the slurry thickens to an extent unsuitable for roll coating. Even if the slurry settles and thickens, however, the slurry may be remixed to its initial viscosity. The thixotropic index of the slurry can be stable such that the slurry does not thicken to unsuitable levels at dead spots in the pan of a roll coating assembly.

The viscosity of the slurry can be controlled by controlling the extent of hydrogen bonding by adding acid to the slurry during mixing. In addition, acid or base may be added to the slurry during mixing in order to control the pH level of the slurry. The pH level of the slurry can be from about 3 to about 12. The pH level of the slurry can be about 5 to about 8. The pH level of the slurry can be about 3, about 4, about 5, about 6, about 7, about 8, about 9, about 10, about 11, or about 12. The pH level of the slurry may change as the slurry settles. Remixing the slurry after the slurry settles may return the pH level of the slurry to initial pH levels. Varying levels of binder, for example, metal acetate, may be added to a slurry to increase green strength in a slurry.

The fluidity of a slurry can be measured by a tilt test. A tilt test can be an indication of yield stress and viscosity. As an alternative, a rheometer may be used to measure the fluidity of the slurry.

The drying time of the slurry can be sufficiently long such that the slurry remains wet during the roll coating process and does not dry until after a coating of the slurry is applied to the substrate. The slurry may not dry at room temperature. The slurry may become dry to the touch after subjecting the drying zone of a roll coating line to heat for around ten seconds. The temperature of heat applied may be around 120° C.

The specific gravity of the slurry can be about 1 to 10 g/cm$^3$. The green strength of the slurry can be such that the slurry is able to withstand roll coating such that the slurry coated substrate is not damaged. For example, a dry film of slurry, dried after roll-coating in the drying oven adjacent to the paint booth, may have a green strength that allows the film to survive a force that flexes the film, twenty times, in alternating negative and positive directions, to an arc with a diameter of 20 inches. The green strength of the dry film of slurry may further allow the film to pass a tape test with a small amount of powdering. The tape test may involve contacting a piece of tape with the surface of the coated material. The tape, once removed from the surface of the coated material, may be clear enough to allow one to see through any powder that had adhered to the tape.

An elemental species in the slurry can diffuse to or into the substrate according to a concentration gradient. For example, the concentration of the elemental species in the metal-containing layer can be highest on the surface of the substrate and can decrease according to a gradient along the depth of the substrate. The decrease in concentration can be linear, parabolic, Gaussian, or any combination thereof. The concentration of the elemental species in the metal-containing layer can be selected based on the desired thickness of the alloy layer to be formed on the substrate.

An elemental species in the slurry may impact the adhesion of the metal-containing layer to the substrate. In addition, an elemental species may impact the viscosity of the metal-containing-containing layer composition. Further, an elemental species may influence the green strength of the metal-containing layer coated substrate. Green strength generally refers to the ability of a metal-containing layer coated substrate to withstand handling or machining before the metal-containing layer is completely cured. Accordingly, an elemental species may be selected based on the desired degree of adhesion of the metal-containing layer to the substrate, the desired viscosity of the metal-containing layer, and the ability of an elemental species to increase the green strength of the metal-containing layer coated substrate. In addition, some metal-containing halides can be corrosive to components of a roll coating assembly which applies the metal-containing layer to the substrate. Such corrosion may be undesirable. An elemental species may prevent the formation of Kirkendall voids at the boundary interface of the metal-containing layer and the substrate. Upon heating, an elemental species may decompose to an oxide. In addition, after annealing, an elemental species may become inert. The concentration of various elemental species can be variable.

The substrate may be pretreated before a slurry is applied to the substrate. The substrate may be pretreated by using chemicals to modify the surface of the substrate in order to improve adhesion of the metal-containing layer to the surface of the substrate. Examples of such chemicals include chromates and phosphates.

The surface of the substrate may be free of processing oxides. This may be achieved by conventional pickling. The surface of the substrate can be reasonably free of organic materials. The surface of the substrate may be reasonably free of organic materials after processing with commercially available cleaners.

Grain pinning particles may be added, removed, or withheld from the substrate during preparation of the substrate in order to control the grain size of the substrate. For example, grain pinners may be added to the substrate in order to keep the grain size small and to form pinning points. As another example, grain pinners may be withheld from the substrate to allow the grains to grow large and to allow for motor laminations. Grain pinners may be insoluble at the annealing temperatures.

Examples of grain pinning particles include an intermetallic, a nitride, a carbide, a carbonitride of titanium, aluminum, niobium, vanadium, and any combination thereof. Non-limiting examples of grain pinning particles include titanium nitride (TiN), titanium carbide (TiC), and aluminum nitride (AlN).

Formation of Metal Layers Adjacent to Substrates

A slurry can be applied or deposited adjacent to the substrate and form a metal-containing layer adjacent to the surface. The metal-containing layer can be annealed to form a metal layer adjacent to the substrate. The slurry can be applied by roll coating, split coating, spin coating, slot coating, curtain coating, slide coating, extrusion coating, painting, spray painting, electrostatic mechanisms, printing (e.g., 2-D printing, 3-D printing, screen printing, pattern printing), vapor deposition (e.g., chemical vapor deposition), electrochemical deposition, slurry deposition, dipping, spraying, any combination thereof, or through any other suitable method.

A slurry can be applied via roll coating. The roll coating process may begin by providing a substrate, such as a steel substrate. Next, the coiled substrate may be unwound. Next, the unwound steel substrate may be provided to roll coaters, which may be coated with a metal-containing layer. Next, the roll coaters may be activated such that the roll coaters coat the substrate with a metal-containing layer. The substrate may be fed through the roll coaters through multiple cycles such that the metal-containing layer is applied to the substrate multiple times. Depending on the properties of the metal-containing layer, it may be desirable to apply multiple coatings to the substrate. Multiple coatings of the metal-containing layer can be applied to the substrate in order to achieve the desired thickness of the slurry. Different formulations or a metal-containing layer may be used in each of the multiple coatings. The metal-containing layer may be applied in a manner such as to form a pattern on the substrate. The pattern may in the form of, for example, a grid, stripes, dots, welding marks, or any combination thereof. Multiple coatings on the same substrate may form a split coat on a substrate.

A slurry can be applied, deposited, or annealed adjacent to the substrate. A slurry can be deposited at a temperature of at least 0° C., 25° C., 50° C., 75° C., 100° C., 200° C., 300° C., 400° C., 500° C., 600° C., 700° C., 800° C., 900° C., or 1000° C. A slurry can be deposited at a temperature from about 0° C. to 1000° C. A slurry can be deposited at a temperature from about 10° C. to 100° C. A slurry can be deposited at a temperature from about 100° C. to 500° C. A slurry can be deposited at a temperature from about 500° C. to 1000° C.

Deposition of a slurry on a substrate may occur in an atmosphere with levels of moisture below or about 90%, 80%, 70%, 60%, 50%, 40%, 30%, 20%, or 10% relative humidity. Deposition of a slurry on a substrate may occur in an atmosphere with levels of moisture below or about 100 torr, 50 torr, 20 torr, 10 torr, 5 torr, 2 torr, 1 torr, or 0.5 torr. In some embodiments, the relative humidity is about 50% during deposition of a metal-containing layer.

Deposition of a slurry on a substrate may occur in an atmosphere with levels of oxygen below or about 20 torr, 10 torr, 5 torr, 2 torr, 1 torr, 0.5 torr, 0.1 torr, 0.05 torr, 0.01 torr, 0.005 torr, or 0.001 torr. Drying a slurry on a substrate may occur in ambient air conditions.

Annealing of the slurry on the substrate may occur in an atmosphere with low levels of oxygen, such as below or about 0.5 torr, 0.1 torr, 0.05 torr, 0.01 torr, 0.005 torr, or 0.001 torr.

Drying of a metal-containing layer on a substrate may occur in an atmosphere with levels of hydrogen below or about 0.1 torr, 0.05 torr, 0.01 torr, 0.005 torr, or 0.001 torr. Annealing of a metal-containing layer on a substrate may occur in an atmosphere of pure hydrogen, pure argon, or a mixture of hydrogen and argon.

After the slurry is applied to the substrate, the solvent in the metal-containing layer may be removed by heating, vaporization, vacuuming, or any combination thereof. After the solvent is driven off, the substrate may be recoiled.

The slurry coated substrate may be incubated or stored under vacuum or atmospheric conditions after deposition and prior to annealing. This occurs prior to annealing and may be useful in removing residual contaminants from the coating, for example, solvent or binder leftover from the coating process. The incubation period may last from about 10 seconds to about 5 minutes or may be more than about 5 minutes. The incubation period may be the time between coating and annealing, and may be the length of time needed to transport the coated article to the heat treatment facility or equipment. For example, the incubation period may last for about 10 seconds, about 30 seconds, about 1 minute, about 2 minutes, about 3 minutes, about 4 minutes, or about 5 minutes. The incubation temperature may range from about 50° C. to about 300° C. For example, the incubation temperature may be more than about 50° C., about 75° C., about 100° C., about 125° C., about 150° C., about 175° C., about 200° C., about 225° C., about 250° C., about 275° C., or about 300° C. After incubating, and prior to annealing, the dry film of slurry on the substrate can be maintained under vacuum conditions. The coating may be dry to the touch immediately following the drying step after the roll-coating process. Absorbed water or other contaminants may be present with the coating anytime between roll coating and annealing.

A slurry coated substrate may be recoiled prior to annealing. The slurry coated substrate may be placed in a retort and subjected to a controlled atmosphere during heat treatment. Removal of water may be necessary. Pulling vacuum to force hydrogen between wraps may be necessary. The annealing process may be via tight coil or loose coil annealing. Annealing the slurry layer coated substrate can allow the elemental species in the slurry to diffuse into or through the substrate. Less than about 100 wt %, 90 wt %, 80 wt %, 70 wt %, 60 wt %, 50 wt %, 40 wt %, 30 wt %, 20 wt %, 10 wt %, or 5 wt % of the elemental species may diffuse to or into the substrate upon annealing. Certain process conditions may afford only 1-5% of the elemental species diffusing from the coating into the substrate. Diffusion of the elemental species to the substrate may be aided by a component in the slurry layer. The annealing process may be a continuous annealing process. The annealing process may be a non-continuous annealing process.

The substrate may be heated at a rate of greater than about 0.01° C. per second, 0.1° C. per second, 1° C. per second, 5° C. per second, 10° C. per second, 15° C. per second, 20° C. per second, 25° C. per second, or 30° C. per second. The substrate may be heated at a rate of greater than about 0.01° C. per minute, 0.1° C. per minute, 1° C. per minute, 5° C. per minute, 10° C. per minute, 15° C. per minute, 20° C. per minute, 25° C. per minute, or 30° C. per minute.

The substrate that has been coated with a slurry can be annealed at a temperature of at least 0° C., 25° C., 50° C., 75° C., 100° C., 200° C., 300° C., 400° C., 500° C., 600° C., 700° C., 800° C., 900° C., 1000° C., 1100° C., 1200° C., or 1300° C. The annealing temperature may be about 800° C., 900° C., 1000° C., 1100° C., 1200° C., or 1300° C. The heating temperature during annealing can be from about 800° C. to about 1300° C., such as from about 900° C. to about 1000° C. The annealing temperature can be about 900° C., 925° C., 950° C. or 1000° C.

During heating, iron in a substrate or metal-containing layer may transition from ferrite to austenite. The temperature at which the transition occurs may be referred to as the ferrite-austenite transition temperature. The ferrite-austenite transition temperature of a substrate or metal-containing layer may be greater than about 500° C., 600° C., 700° C., 800° C., 900° C., 1000° C., 1100° C., 1200° C., 1300° C., 1400° C., 1500° C., or 1600° C. The ferrite-austenite transition temperature of a substrate may be about 900° C., 1000° C., 1100° C., 1200° C., or 1300° C. The ferrite-austenite transition temperature of a substrate can be from about 900° C. to about 1300° C., about 1000° C. to about 1200° C., or about 1100° C. to about 1200° C.

The total annealing time, including heating, can range from about 5 hours to about 200 hours. For example, the total annealing time can be more than about 5 hours, about 20 hours, about 40 hours, about 60 hours, about 80 hours, about 100 hours, about 120 hours, about 140 hours, about 160 hours, about 180 hours, or about 200 hours. The maximum temperature during the annealing process may be reached in about 1 hour to 100 hours. For example, the maximum temperature during the annealing process may be reached in about 1 hour, 10 hours, 20 hours, 30 hours, 40 hours, 50 hours, 60 hours, 70 hours, 80 hours, 90 hours, or 100 hours. In some embodiments, a substrate may be annealed at about 950° C. for at least about 5 hours. In some embodiments, a substrate may be annealed at about 950° C. for at least about 20 hours. In some embodiments, a substrate may be annealed at about 950° C. for at least about 40 hours. In some embodiments, a substrate may be annealed at about 900° C. for at least about 20 hours. In some embodiments, a substrate may be annealed at about 900° C. for at least about 40 hours. In some embodiments, a substrate may be annealed at about 900° C. for at least about 60 hours. In some embodiments, a substrate may be annealed at about 900° C. for at least about 80 hours.

The annealing atmosphere may comprise an inert gas, for example, hydrogen, nitrogen, or argon. The annealing atmosphere can be a vacuum. To prevent loss of an elemental species during annealing, hydrochloric acid may be added to the annealing gas. Minimizing the partial pressure of a component in the metal-containing layer in the reactor at high temperatures may maintain a low deposition rate that is essential for minimizing or stopping the formation of Kirkendall pores. Adding too much of an acidic component in the metal-containing layer may also cause corrosion of the coating equipment or the substrate.

After annealing, the metal layer coated substrate may be dried. The drying of the metal layer coated substrate may occur in a vacuum or near-vacuum atmosphere. The drying of the metal layer coated substrate may occur in an atmosphere of an inert gas. Examples of inert gas include hydrogen, helium, argon, nitrogen, or any combination thereof.

The substrate may be cooled for a period of time after annealing. The cooling time can range from about 1 hour to about 100 hours. For example, the cooling time can be more than about 1 hour, 2 hours, 3 hours, 4 hours, 5 hours, 6 hours, 7 hours, 8 hours, 9 hours, 10 hours, 15 hours, 20 hours, 25 hours, 30 hours, 35 hours, 40 hours, 50 hours, 60 hours, 70 hours, 80 hours, 90 hours, or 100 hours. For example, the cooling time can be from 1 hour to about 100 hours, from about 5 hours to about 50 hours, or from about 10 hours to about 20 hours.

Large articles may have hot spots or cold spots during thermal treatment, where an article may be coated evenly but heated unevenly. Hot spots or cold spots may be indicated to control the diffusion of alloying element into the article as uniformly as possible.

After annealing, a metal layer may be formed on the substrate. The metal layer may have at least one elemental species chosen from carbon, manganese, silicon, vanadium, titanium, niobium, phosphorus, sulfur, aluminum, copper, nickel, chromium, molybdenum, tin, boron, calcium, arsenic, cobalt, lead, antimony, tantalum, tungsten, zinc, and zirconium, where the elemental species has a concentration that varies by less than about 20 wt. %, about 15 wt. %, about 10 wt. %, about 5 wt. %, about 4 wt. %, about 3 wt. %, about 2 wt. %, about 1 wt. %, or about 0.5 wt. % in the outer layer. The substrate may comprise a bonding layer adjacent to the metal layer. The concentration of an elemental species may decrease by less than about 1.0 wt % in the bonding layer. A metal or alloy layer may be uniform in appearance. The metal or alloy layer may be level, unvarying, smooth, even, and homogenous in appearance, weight, and thickness over the surface of the at least a portion of the layer. A metal or alloy layer may have grain boundary precipitates that may be visible. Alternatively, a metal or alloy layer formed with a composition or via a method described herein may have little or few grain boundary precipitates that are visible at 10×, 50×, 100×, 250×, 500×, 1000×, or more magnification.

A residue may remain on the substrate after the annealing process. Certain components in the metal layer may be consumed or removed (e.g., deposited on the walls of the retort), or its concentration reduced due to its diffusion to or into the substrate. However, after annealing, other residue in the form of, e.g., a powder, may remain on the substrate. The residue may comprise the inert material from the metal-containing layer. This residue may be removed prior to further processing (e.g., temper rolling). The reaction can be purged with HCl gas to halt the reaction. The purging with HCl gas can allow for the formation of a flat profile.

After a metal layer is formed adjacent to a substrate, the substrate may have a measurable grain size. Grain size may be measured and recorded in accordance to the American Society of the International Association for Testing and Materials (ASTM) standard. The substrate may have a grain size greater than about ASTM 1, 2, 3, 4, 5, 6, 7, 8, 9, 10, 11, 12, 13, 14, 15, 16, 17, 18, 19, 20, 21, 22, 23, 24, 25, 26, 27, 28, 39, or 30. In some embodiments, a metal layer may have a grain size from about ASTM 1 to about ASTM 30, from about ASTM 5 to about ASTM 16, from about ASTM 6 to about ASTM 14, or from about ASTM 8 to about ASTM 12. A substrate may have a grain size from about ASTM 7 to ASTM 9. A substrate may have a grain size about ASTM 7.

An elemental species in the slurry may lower the transition temperature of austenite to ferrite. An elemental species in the substrate may lower the transition temperature of austenite to ferrite. An elemental species may not substantially change the transition temperature of austenite to ferrite. In some embodiments, an elemental species may raise the transition temperature of austenite to ferrite. An elemental species that may lower the transition temperature of austenite to ferrite can be manganese, nitrogen, copper or gold.

The grain size of austenite and the grain size of ferrite may be measured. A ratio of austenite grain size to ferrite grain size may be greater than about 0.1, 0.5, 1, 2, 5, or 10. A ratio of austenite grain size to ferrite grain size may be about 0.1, 0.5, 1, 2, 5, or 10. A ratio of austenite grain size to ferrite grain size may be about 1. The ratio of grain size of austenite to grain size of ferrite may be calculated according to the following equation:

$$D_\gamma/D_\alpha=1+(0.0026+0.053\text{ wt \% C}+0.006\text{ wt \% Mn}+0.009\text{ wt \% Nb}+4.23\text{ wt \% V}*\text{N}-0.081\text{ wt \% Ti})*(1.5+\alpha^{1/2})*D_\gamma$$

wherein $D_\gamma$ is the grain size of austenite in μm, $D_\alpha$ is the grain size of ferrite in μm, α is the cooling rate in ° C./s.

The amount of titanium equivalents stabilization may be calculated according to the following equation:

$$\text{Ti equivalents stabilization}=\text{wt \% Ti}-3.42*\text{wt \% N}-1.49\text{ wt \% S}-4\text{ wt \% C}+0.516\text{ wt \% Nb}.$$

Without wishing to be bound by theory, a certain amount of titanium (Ti) equivalents stabilization in a metal layer that may give rise to a layer that is more resistant to grain boundary precipitation. A metal layer may comprise at least about 0.001 Ti equivalents, 0.005 Ti equivalents, 0.01 Ti equivalents, 0.015 Ti equivalents, 0.017 Ti equivalents, 0.02 Ti equivalents, 0.03 Ti equivalents, 0.04 Ti equivalents, 0.05 Ti equivalents, 0.06 Ti equivalents, 0.07 Ti equivalents, 0.08 Ti equivalents, 0.09 Ti equivalents, or more.

The amount of an elemental metal in a metal layer on a substrate may change with depth. The amount of an elemental metal in a metal layer may have a change with depth at a certain rate, such as at least about −0.01% per micrometer, at least about −0.01% per micrometer, at least about −0.01% per micrometer, at least about −0.05% per micrometer, at least about −0.1% per micrometer, at least about −0.5% per micrometer, at least about −1.0% per micrometer, at least about −3.0% per micrometer, at least about −5.0% per micrometer, at least about −7.0% per micrometer, or at least about −9.0% per micrometer. The amount of an elemental metal in a metal layer may have a change with depth from about −0.01% per micrometer to −5.0% per micrometer, or from about −0.01% per micrometer to −3.0% per micrometer.

The amount of an elemental metal in a metal layer may have a change with depth at a certain rate, such as at most about −0.01% per micrometer, at most about −0.01% per micrometer, at most about −0.01% per micrometer, at most about −0.05% per micrometer, at most about −0.1% per micrometer, at most about −0.5% per micrometer, at most about −1.0% per micrometer, at most about −3.0% per micrometer, at most about −5.0% per micrometer, at most about −7.0% per micrometer, or at most about −9.0% per micrometer.

An elemental metal may have a concentration of at least about 5 wt % at a depth of less than or equal to 100 micrometers, about 5 wt % at a depth of less than or equal to 50 micrometers, about 10 wt % at a depth of less than or equal to 50 micrometers, about 10 wt % at a depth of less than or equal to 40 micrometers, about 10 wt % at a depth of less than or equal to 30 micrometers, about 15 wt % at a depth of less than or equal to 50 micrometers, about 15 wt % at a depth of less than or equal to 40 micrometers, about 15 wt % at a depth of less than or equal to 30 micrometers, or about 15 wt % at a depth of less than or equal to 10 micrometers from the surface of the substrate. X-ray photoelectron spectroscopy may be used to measure such change in amount, concentration, or wt % with depth.

A metal layer that is coated adjacent to a substrate may have a thickness less than about 1 millimeter, about 900 micrometers, about 800 micrometers, about 700 micrometers, about 600 micrometers, about 500 micrometers, 400 micrometers, about 300 micrometers, about 200 micrometers, or about 100 micrometers.

A metal layer that is coated adjacent to a substrate may have a thickness of at least about 1 micrometer, 5 micrometers, 10 micrometers, 20 micrometers, 30 micrometers, 40 micrometers, 50 micrometers, 60 micrometers, 70 micrometers, 80 micrometers, 90 micrometers, 100 micrometers, 200 micrometers, 300 micrometers, 400 micrometers, 500 micrometers, 600 micrometers, 700 micrometers, 800 micrometers, 900 micrometers, or more.

Properties of a substrate, prior to coating with a metal layer or after coating with a metal layer, may be determined by various techniques and instruments. Techniques and instruments include, for example, grain size calculations, scanning electron microscope (SEM), scanning electron microscope/energy dispersive spectroscopy (SEM/EDS), microprobe analysis, and potentiostat measurements.

Properties of a substrate after coating with a metal layer may be measured. Properties of a substrate include, for example, chemical composition, yield strength, ultimate tensile strength, and percent elongation.

The substrate can be substantially free of Kirkendall voids after annealing. The layer can impart characteristics on the substrate which the substrate did not previously contain. For example, the layer may make the substrate harder, more wear resistant, more aesthetically pleasing, more electrically resistive, less electrically resistive, more thermally conductive, less thermally conductive, or any combination thereof. In addition, the layer may cause the speed of sound in the substrate to be faster or slower.

The yield strength of a substrate may be greater than about 100 psi, 1 ksi (kilopound per square inch), 2 ksi, 5 ksi, 10 ksi, 15 ksi, 20 ksi, 21 ksi, 22 ksi, 23 ksi, 24 ksi, 25 ksi, 26 ksi, 27 ksi, 28 ksi, 29 ksi, 30 ksi, or 35 ksi. The yield strength of a substrate may be about 20 ksi, 21 ksi, 22 ksi, 23 ksi, 24 ksi, 25 ksi, 26 ksi, 27 ksi, 28 ksi, 29 ksi, or 30 ksi.

The ultimate tensile strength of a substrate may be greater than about 30 ksi, 35 ksi, 40 ksi, 50 ksi, 55 ksi, 60 ksi, 70 ksi, 80 ksi, 90 ksi, or 100 ksi. The ultimate tensile strength of a substrate may be about 45 ksi, 46 ksi, 47 ksi, 48 ksi, 49 ksi, 50 ksi, 51 ksi, 52 ksi, 53 ksi, 54 ksi, 55 ksi, or 56 ksi.

A substrate may exhibit a percent elongation, a maximum elongation of the gage divided by the original gage length, or the difference in distance prior to fracture before and after coating with a steel substrate. The percent elongation may be about 5%, 10%, 20%, 30%, 40%, 50%, 60%, 70%, 80%, 90%, or 100%. In some embodiments, the percent elongation may be about 30%, 31%, 32%, 33%, 34%, 35%, 36%, 37%, 38%, 39%, or 40%.

Other properties of substrates coated with metal layers may be as described in, for example, U.S. Patent Publication No. 2013/0171471; U.S. Patent Publication No. 2013/0309410; U.S. Patent Publication No. 2013/0252022; U.S. Patent Publication No. 2015/0167131; U.S. Patent Publication No. 2015/0345041, U.S. Patent Publication No. 2015/0345041, U.S. Patent Publication No. 2016/0230284, each of which is incorporated herein by reference in its entirety.

Computer Control Systems

Figure 4:
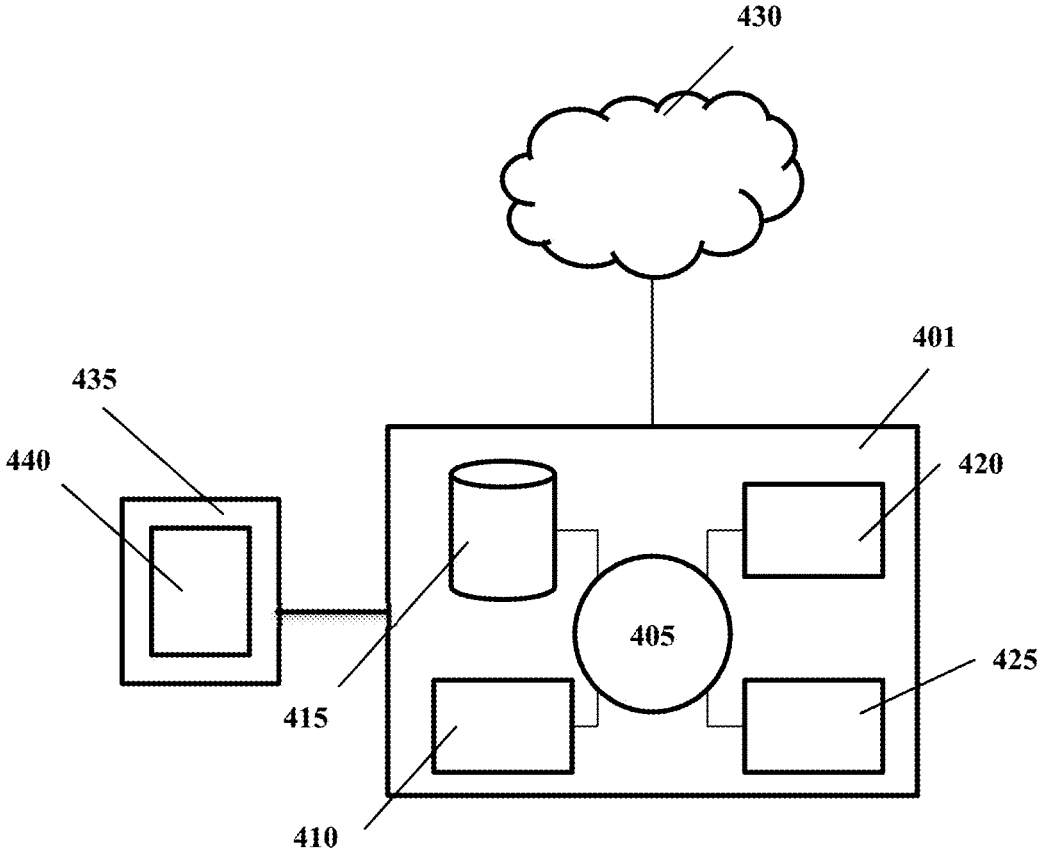
FIG. 4 shows a computer control system that is programmed or otherwise configured to implement methods provided herein.

The present disclosure provides computer control systems that are programmed to implement methods of the disclosure. FIG. 4 shows a computer control system 401 that is programmed or otherwise configured to produce the slurry and/or apply a coating of the slurry to a substrate. The computer control system 401 can regulate various aspects of the methods of the present disclosure, such as, for example, methods of producing the slurry and methods of applying a coating of the slurry to the substrate. The computer control system 401 can be implemented on an electronic device of a user or a computer system that is remotely located with respect to the electronic device. The electronic device can be a mobile electronic device.

The computer system 401 includes a central processing unit (CPU, also "processor" and "computer processor" herein) 405, which can be a single core or multi core processor, or a plurality of processors for parallel processing. The computer control system 401 also includes memory or memory location 410 (e.g., random-access memory, read-only memory, flash memory), electronic storage unit 415 (e.g., hard disk), communication interface 420 (e.g., network adapter) for communicating with one or more other systems, and peripheral devices 425, such as cache, other memory, data storage and/or electronic display adapters. The memory 410, storage unit 415, interface 420 and peripheral devices 425 are in communication with the CPU 405 through a communication bus (solid lines), such as a motherboard. The storage unit 415 can be a data storage unit (or data repository) for storing data. The computer control system 401 can be operatively coupled to a computer network ("network") 430 with the aid of the communication interface 420. The network 430 can be the Internet, an internet and/or extranet, or an intranet and/or extranet that is in communication with the Internet. The network 430 in some cases is a telecommunication and/or data network. The network 430 can include one or more computer servers, which can enable distributed computing, such as cloud computing. The network 430, in some cases with the aid of the computer system 401, can implement a peer-to-peer network, which may enable devices coupled to the computer system 401 to behave as a client or a server.

The CPU 405 can execute a sequence of machine-readable instructions, which can be embodied in a program or software. The instructions may be stored in a memory location, such as the memory 410. The instructions can be directed to the CPU 405, which can subsequently program or otherwise configure the CPU 405 to implement methods of the present disclosure. Examples of operations performed by the CPU 405 can include fetch, decode, execute, and writeback.

The CPU 405 can be part of a circuit, such as an integrated circuit. One or more other components of the system 401 can be included in the circuit. In some cases, the circuit is an application specific integrated circuit (ASIC).

The storage unit 415 can store files, such as drivers, libraries and saved programs. The storage unit 415 can store user data, e.g., user preferences and user programs. The computer system 401 in some cases can include one or more additional data storage units that are external to the computer system 401, such as located on a remote server that is in communication with the computer system 401 through an intranet or the Internet.

The computer system 401 can communicate with one or more remote computer systems through the network 430. For instance, the computer system 401 can communicate with a remote computer system of a user (e.g., a user controlling the manufacture of a slurry coated substrate). Examples of remote computer systems include personal computers (e.g., portable PC), slate or tablet PC's (e.g., Apple® iPad, Samsung® Galaxy Tab), telephones, Smart phones (e.g., Apple® iPhone, Android-enabled device, Blackberry®), or personal digital assistants. The user can access the computer system 401 via the network 430.

Methods as described herein can be implemented by way of machine (e.g., computer processor) executable code stored on an electronic storage location of the computer system 401, such as, for example, on the memory 410 or electronic storage unit 415. The machine executable or machine readable code can be provided in the form of software. During use, the code can be executed by the processor 405. In some cases, the code can be retrieved from the storage unit 415 and stored on the memory 410 for ready access by the processor 405. In some situations, the electronic storage unit 415 can be precluded, and machine-executable instructions are stored on memory 410.

The code can be pre-compiled and configured for use with a machine having a processor adapted to execute the code, or can be compiled during runtime. The code can be supplied in a programming language that can be selected to enable the code to execute in a pre-compiled or as-compiled fashion.

Aspects of the systems and methods provided herein, such as the computer system 401, can be embodied in programming. Various aspects of the technology may be thought of as "products" or "articles of manufacture" typically in the form of machine (or processor) executable code and/or associated data that is carried on or embodied in a type of machine readable medium. Machine-executable code can be stored on an electronic storage unit, such as memory (e.g., read-only memory, random-access memory, flash memory) or a hard disk. "Storage" type media can include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer into the computer platform of an application server. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium, such as computer-executable code, may take many forms, including but not limited to, a tangible storage medium, a carrier wave medium or physical transmission medium. Non-volatile storage media include, for example, optical or magnetic disks, such as any of the storage devices in any computer(s) or the like, such as may be used to implement the databases, etc. shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a ROM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

The computer system 401 can include or be in communication with an electronic display 435 that comprises a user interface (UI) 440 for providing, for example, parameters for producing the slurry and/or applying the slurry to a substrate. Examples of UI's include, without limitation, a graphical user interface (GUI) and web-based user interface.

Methods and systems of the present disclosure can be implemented by way of one or more algorithms. An algorithm can be implemented by way of software upon execution by the central processing unit 405. The algorithm can, for example, regulate the mixing shear rate of the slurry, the amount of each ingredient added to the slurry mixture, and the order in which the ingredients are added to the slurry mixture. As another example, the algorithm can regulate the speed at which the slurry is applied to the substrate and the number of coatings of slurry applied to the substrate.

EXAMPLES

Example 1

In an example, a slurry is formed by addition to a mixing chamber while mixing a resulting solution. The amount of water added to the slurry is varied to form a number of slurries, and the resulting effect on properties of the slurries is recorded. Next, the slurry is applied to a substrate via a roll coating process. The slurry is then annealed at 200° C. for 2 hours. The slurry is then dried to completeness from about 2 hours to about 100 hours or longer. The atmosphere near the chromized article's surface may be below −20° F. dew point.

Example 2

In an example, a substrate is heated at a rate of 10° C./min to 500° C. The temperature is held constant for 2 hours, during which time a metal-containing layer is deposited adjacent the substrate. The substrate is then heated at a rate of 10° C./min to 950° C. The temperature is held constant during the annealing process. After 30 hours, the substrate is cooled at a rate of approximately 5° C./min to room temperature. A flow of argon is constant during the entire process.

Example 3

In an example, a substrate undergoes a thermal cycle protocol. A substrate is heated at a rate of 10° C./min to 500° C. The temperature is held constant for 2 hours, during which time a metal-containing layer is deposited adjacent to the substrate. The substrate is then heated at a rate of 10° C./min to 925° C., and the temperature is held constant for 30 minutes. The substrate is cooled at a rate of 5° C./min to 500° C., where the temperature is held constant for 30 minutes. The substrate is heated again, at a rate of 5° C./min to 925° C., held at a constant temperature for 30 minutes, then cooled at a rate of 5° C./min to 500° C. and held constant for 30 minutes. The substrate is heated and cooled one more time in another cycle. The substrate is heated one final time to 925° C., then the substrate is cooled at a rate of approximately 5° C./min to room temperature. A flow of argon is constant during the entire process.

Example 4

In an example, substrates were provided, comprising carbon, silicon, manganese, titanium, vanadium, aluminum, and nitrogen. In an example, substrates have the following components, in wt %:

| Substrate | C | Si | Mn | Ti | V | Al | N |
|---|---|---|---|---|---|---|---|
| S-03 | 0.035 | 0.333 | 0.634 | 0.281 | 0.018 | 0.059 | 0.0051 |
| S-04 | 0.032 | 0.321 | 0.592 | 0.245 | 0.015 | 0.03 | 0.0065 |
| C13 | 0.0072 | 0.016 | 1.6 | 0.019 | 0.11 | 0.0012 | 0.012 |
| C19 | 0.007 | 0.02 | 1.23 | 0.016 | 0.09 | 0.008 | 0.01 |
| C20 | 0.007 | 0.02 | 1.25 | 0.015 | 0 | 0.006 | 0.008 |
| C21 | 0.004 | 0.02 | 1.24 | 0.014 | 0.09 | 0.011 | 0.009 |

Example 5

In an example, substrates were provided, comprising carbon, silicon, manganese, titanium, vanadium, aluminum, and nitrogen. In an example, substrates have the following components, in wt %:

| Substrate | C | Mn | Al | P | S | Cr | N | V | Nb | Ti |
|---|---|---|---|---|---|---|---|---|---|---|
| C20_2 | 0.002 | 1.27 | 0.008 | 0.009 | 0.005 | 0.04 | 0.008 | 0.004 | 0.004 | 0.016 |
| MC-25 | 0.002 | 1.26 | 0.004 | 0.005 | 0.008 | 0.04 | 0.008 | 0 | 0.089 | 0.015 |

Substrate MC-25 had 0.089 wt % niobium. The resulting alloy layer had little observed grain boundary precipitation, as illustrated in FIG. 3. Fewer formation of pores were observed with this alloy layer. This stainless steel alloy layer had improved corrosion resistance, a desired effect of the substrate.

Example 6

In an example, substrates were formed and exhibited the following properties:

| Substrate | Average grain size (ASTM) | Coefficient of Variation (%) | Yield strength (ksi) | Ultimate tensile strength (ksi) | Percent Elongation |
|---|---|---|---|---|---|
| S-03 | 7.33 | 3 | 22.8 | 54.5 | 33 |
| S-04 | 7.4 | 9 | 23.3 | 55 | 36 |
| C20 | 7.25 | 4 | 20.4 | 48 | 36 |

Materials, devices, systems and methods herein, including material compositions (e.g., material layers), can be combined with or modified by other materials, devices, systems and methods, including material compositions, such as, for example, those described in U.S. Patent Publication No. 2013/0171471; U.S. Patent Publication No. 2013/0309410; U.S. Patent Publication No. 2013/0252022; U.S. Patent Publication No. 2015/0167131; U.S. Patent Publication No. 2015/0345041; and Patent Cooperation Treaty Application No. PCT/US2016/017155, each of which is incorporated herein by reference in its entirety.

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

What is claimed is:

1. A method for forming at least one metal layer adjacent to a substrate, the substrate provided as a coil, a coiled mesh, a wire, a pipe, a tube, a slab, a mesh, a dipped formed part, a foil, a plate, a wire rope, a rod, a threaded rod where a screw pattern has been applied to any length or thickness of rod, a sheet, or a planar surface, the method comprising:

(a) providing said substrate having a grain size that is from about International Association for Testing and Materials (ASTM) 1 to ASTM 30, wherein said substrate includes at least two of (i) carbon at less than or equal to about 0.1 wt %, (ii) manganese at about 0.1 wt % to 3 wt %, (iii) silicon at less than or equal to about 1 wt %, (iv) vanadium at less than or equal to about 0.1 wt %, and (v) titanium at less than or equal to about 0.5 wt %, the balance of the substrate being iron;

(b) depositing at least one metal-containing layer adjacent to said substrate;

(c) annealing said substrate and said at least one metal-containing layer, thereby forming said at least one metal layer adjacent to said substrate, wherein said at least one metal layer has a grain size greater than about ASTM 6; and (d) after said annealing, drying said substrate and said at least one metal-containing layer in a vacuum, or near-vacuum atmosphere, or an atmosphere of an inert gas.

2. The method of claim 1, wherein said substrate includes at least three of (i) carbon at less than or equal to about 0.1 wt %, (ii) manganese at about 0.1 wt % to 3 wt %, (iii) silicon at less than or equal to about 1 wt %, (iv) vanadium at less than or equal to about 0.1 wt %, and (v) titanium at less than or equal to about 0.5 wt %.

3. The method of claim 2, wherein said substrate includes at least four of (i) carbon at less than or equal to about 0.1 wt %, (ii) manganese at about 0.1 wt % to 3 wt %, (iii) silicon at less than or equal to about 1 wt %, (iv) vanadium at less than or equal to about 0.1 wt %, and (v) titanium at less than or equal to about 0.5 wt %.

4. A method for forming at least one metal layer adjacent to a substrate, the substrate provided as a coil, a coiled mesh, a wire, a pipe, a tube, a slab, a mesh, a dipped formed part, a foil, a plate, a wire rope, a rod, a threaded rod where a screw pattern has been applied to any length or thickness of rod, a sheet, or a planar surface, the method comprising:

(a) providing said substrate having a grain size that is from about International Association for Testing and Materials (ASTM) 1 to ASTM 30, wherein said substrate includes at least two of (i) carbon at less than or equal to about 0.1 wt %, (ii) manganese at about 0.1 wt % to 3 wt %, (iii) silicon at less than or equal to about 1 wt %, (iv) vanadium at less than or equal to about 0.1 wt %, and (v) titanium at less than or equal to about 0.5 wt %, the balance of the substrate being iron;

(b) depositing at least one metal-containing layer adjacent to said substrate; and (c) annealing said substrate and said at least one metal-containing layer, thereby forming said at least one metal layer adjacent to said substrate, wherein said at least one metal layer has a grain size greater than about ASTM 6;

wherein said at least one metal-containing layer comprises an alloying agent, a metal halide activator, and a solvent.

5. The method of claim 4, wherein said alloying agent comprises one or more elements selected from the group consisting of ferrosilicon (FeSi), ferrochrome (FeCr), and chromium.

6. The method of claim 4, wherein said metal halide activator comprises one or more elements selected from the group consisting of a monovalent metal, a divalent metal, and a trivalent metal.

7. The method of claim 4, wherein said metal halide activator comprises one or more elements selected from the group consisting of magnesium chloride ($MgCl_2$), iron (II) chloride ($FeCl_2$), calcium chloride ($CaCl_2$), zirconium (IV) chloride ($ZrCl_4$), titanium (IV) chloride ($TiCl_4$), niobium (V) chloride ($NbCl_5$), titanium (III) chloride ($TiCl_3$), silicon tetrachloride ($SiCl_4$), vanadium (III) chloride ($VCl_3$), chromium (III) chloride ($CrCl_3$), trichlorosilance ($SiHCl_3$), manganese (II) chloride ($MnCl_2$), chromium (II) chloride ($CrCl_2$), cobalt (II) chloride ($CoCl_2$), copper (II) chloride ($CuCl_2$), nickel (II) chloride ($NiCl_2$), vanadium (II) chloride ($VCl_2$), ammonium chloride ($NH_4Cl$), sodium chloride (NaCl), potassium chloride (KCl), molybdenum sulfide (MoS), manganese sulfide (MnS), iron disulfide ($FeS_2$), chromium sulfide (CrS), iron sulfide (FeS), copper sulfide (CuS), and nickel sulfide (NiS).

8. The method of claim 1, wherein said metal layer adjacent to said substrate comprises at least one elemental species selected from the group consisting of carbon, manganese, silicon, vanadium, titanium, niobium, phosphorus, sulfur, aluminum, copper, nickel, chromium, molybdenum, tin, boron, calcium, arsenic, cobalt, lead, antimony, tantalum, tungsten, zinc, and zirconium.

9. The method of claim 1, wherein said depositing is by vapor deposition.

10. The method of claim 1, wherein said depositing is by electrochemical deposition.

11. A method for forming at least one metal layer adjacent to a substrate, the substrate provided as a coil, a coiled mesh, a wire, a pipe, a tube, a slab, a mesh, a dipped formed part, a foil, a plate, a wire rope, a rod, a threaded rod where a screw pattern has been applied to any length or thickness of rod, a sheet, or a planar surface, the method comprising:

(a) providing said substrate having a grain size that is from about International Association for Testing and Materials (ASTM) 1 to ASTM 30, wherein said substrate includes at least two of (i) carbon at less than or equal to about 0.1 wt %, (ii) manganese at about 0.1 wt % to 3 wt %, (iii) silicon at less than or equal to about 1 wt %, (iv) vanadium at less than or equal to about 0.1 wt %, and (v) titanium at less than or equal to about 0.5 wt %, the balance of the substrate being iron;

(b) depositing at least one metal-containing layer adjacent to said substrate; and (c) annealing said substrate and said at least one metal-containing layer, thereby forming said at least one metal layer adjacent to said substrate, wherein said at least one metal layer has a grain size greater than about ASTM 6;

wherein said depositing is by slurry deposition.

12. The method of claim 1, wherein said annealing said substrate and said at least one metal-containing layer comprises heating at a temperature above about 500° C.

13. The method of claim 12, wherein during said heating at said temperature above about 500° C., said substrate transitions from ferrite to austenite.

14. The method of claim 12, wherein said temperature is determined by a transition temperature at which ferrite transitions to austenite.

15. The method of claim 14, wherein addition of at least one austenite stabilizer lowers said transition temperature.

16. The method of claim 15, wherein said at least one austenite stabilizer comprises one or more elements selected from the group consisting of manganese, nitrogen, copper, and gold.

17. The method of claim 1, wherein said substrate comprises a stainless steel, silicon steel, or noise vibration harshness damping steel.

18. The method of claim 1, further comprising cooling of said substrate after said annealing of said substrate and said at least one metal-containing layer.

19. A method for forming at least one metal layer adjacent to a substrate, the substrate provided as a coil, a coiled mesh, a wire, a pipe, a tube, a slab, a mesh, a dipped formed part, a foil, a plate, a wire rope, a rod, a threaded rod where a screw pattern has been applied to any length or thickness of rod, a sheet, or a planar surface, the method comprising:

(a) providing said substrate having a grain size that is from about International Association for Testing and Materials (ASTM) 1 to ASTM 30, wherein said substrate includes at least two of (i) carbon at less than or equal to about 0.1 wt %, (ii) manganese at about 0.1 wt % to 3 wt %, (iii) silicon at less than or equal to about 1 wt %, (iv) vanadium at less than or equal to about 0.1 wt %, and (v) titanium at less than or equal to about 0.5 wt %, the balance of the substrate being iron;

(b) depositing at least one metal-containing layer adjacent to said substrate; and (c) annealing said substrate and said at least one metal-containing layer, thereby forming said at least one metal layer adjacent to said substrate, wherein said at least one metal layer has a grain size greater than about ASTM 6;

comprising repeating (b) or (c).

20. The method of claim 1, wherein said substrate has an austenite to ferrite ratio of at least 1 as measured by x-ray diffraction spectroscopy.

21. The method of claim 1, wherein said depositing is by slurry deposition.

22. The method of claim 19, wherein said depositing is by slurry deposition.

23. The method of claim 19, wherein said depositing is by vapor deposition.

24. The method of claim 19, wherein said depositing is by electrochemical deposition.

* * * * *